US006485380B2

(12) United States Patent
Spangler et al.

(10) Patent No.: US 6,485,380 B2
(45) **Date of Patent: *Nov. 26, 2002**

(54) SPORTS IMPLEMENT

(75) Inventors: Ronald Spangler, Somerville, MA (US); David Gilbert, Arlington, MA (US); Carl Prestia, Stow, MA (US); Emanuele Bianchini, Winchester, MA (US); Kenneth B. Lazarus, Concord, MA (US); Jeffrey W. Moore, Arlington, MA (US); Robert N. Jacques, Andover, MA (US); Jonathan C. Allen, Brookline, MA (US); Farla M. Russo, Brookline, MA (US)

(73) Assignee: Active Control eXperts, Inc., Cambridge, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/759,855

(22) Filed: Jan. 12, 2001

(65) Prior Publication Data

US 2001/0001770 A1 May 24, 2001

Related U.S. Application Data

(63) Continuation of application No. 09/057,972, filed on Apr. 9, 1998, now Pat. No. 6,196,935, which is a continuation-in-part of application No. 08/536,067, filed on Sep. 29, 1995, now Pat. No. 5,857,694, and a continuation-in-part of application No. 09/054,940, filed on Apr. 3, 1998, now Pat. No. 6,086,490.

(51) Int. Cl.[7] ..... A63B 49/02

(52) U.S. Cl. ..... 473/521; 473/546; 310/317; 310/326

(58) Field of Search ..... 473/318, 520, 473/521, 523, 546, 558, 559, 564; 310/317, 326

(56) References Cited

U.S. PATENT DOCUMENTS 4,257,594 A * 3/1981 Conrey
RE31,419 E * 10/1983 Frolow (List continued on next page.)

FOREIGN PATENT DOCUMENTS

| | | | |
|---|---|---|---|
| DE | 250203 | 7/1976 | ..... 280/602 |
| EP | 0162372 | 11/1985 | ..... 280/602 |

(List continued on next page.)

*Primary Examiner*—Stephen Blau
(74) *Attorney, Agent, or Firm*—John R. Ross

(57) ABSTRACT

A golf club includes an electroactive assembly attached to the club and electrically tuned to capture energy from one or more vibrational modes with high efficiency. More generally, a sports implement includes an electroactive element, such as a piezoceramic sheet attached to the implement, and a circuit attached to the electroactive element. The circuit may be a shunt, or may include processing such as amplification and phase control to apply a driving signal which may compensate for strain sensed in the implement, or may simply alter the stiffness to affect performance. The electroactive element is located in a region of high strain to apply damping, and may include plural subassemblies mounted to capture energy in different planes, or to capture an asymmetric strain distribution while maintaining structural symmetry. In a ski the element captures between about one and five percent of the strain energy of the ski. The region of high strain may be found by modeling mechanics of the sports implement, or may be located by empirically mapping the strain distribution which occurs during use of the implement. In other embodiments, the electroactive elements may remove resonances, adapt performance to different situations, or enhance handling or comfort of the implement. Other embodiments include striking implements intended to hit a ball or object in play, such as mallets, bats and tennis racquets, wherein the strain elements may alter the performance, feel or comfort of the implement. The electroactive elements may be configured in sets to capture energy in different modes, and/or energy distributed along different directions.

24 Claims, 24 Drawing Sheets

SECTION A-A

U.S. PATENT DOCUMENTS

| | | | | | |
|---|---|---|---|---|---|
| 4,565,940 | A | * | 1/1986 | Hubbard | |
| 4,822,042 | A | * | 4/1989 | Landsman | |
| 4,849,668 | A | | 7/1989 | Crawley et al. | 310/328 |
| 4,870,868 | A | * | 10/1989 | Gastgeb | |
| 4,898,389 | A | | 2/1990 | Plutt | 473/223 |
| 4,940,236 | A | | 7/1990 | Allen | 473/223 |
| 5,007,294 | A | * | 4/1991 | Matjasic | |
| 5,233,544 | A | * | 8/1993 | Kobayashi | |
| 5,315,203 | A | | 5/1994 | Bicos | 310/326 |
| 5,390,949 | A | | 2/1995 | Naganathan | 280/707 |
| 5,419,565 | A | * | 5/1995 | Gordon | |
| 5,439,217 | A | * | 8/1995 | Ganger | |
| 5,499,836 | A | | 3/1996 | Juhasz | 280/602 |
| 5,590,908 | A | | 1/1997 | Curr | 280/601 |
| 5,615,905 | A | | 4/1997 | Stepanek et al. | 280/602 |
| 5,645,260 | A | | 7/1997 | Falangas | 248/550 |
| 5,775,715 | A | | 7/1998 | Vandergrift | 280/602 |
| 6,044,704 | A | * | 4/2000 | Sacher | |
| 6,134,965 | A | * | 10/2000 | Somville | |

FOREIGN PATENT DOCUMENTS

| | | | |
|---|---|---|---|
| FR | 2643430 | 8/1990 | 280/602 |
| SE | 0465603 | 10/1991 | |

* cited by examiner

98a

SPORTS IMPLEMENT

This is a cotinuation of application No. 09/057,972, filed Apr. 9, 1998 now U.S Pat. No. 6,196,935, which is a continuation-in-part of Application No. 08/536,067 filed Sep. 29, 1995, issued as U.S. Pat. No. 5,857,694 and a continuation-in-part of Application No. 09/054,940, filed Apr. 3, 1998, issued as U.S. Pat. No. 6,086,490. The disclosures of each of which are incorporated by reference herein.

BACKGROUND OF THE INVENTION

The present invention relates to sports equipment, and more particularly to damping, controlling vibrations and affecting stiffness of sports equipment, such as a racquet, ski, or the like. In general, a great many sports employ implements which are subject to either isolated extremely strong impacts, or to large but dynamically varying forces exerted over longer intervals of time or over a large portion of their body. Thus, for example, implements such as baseball bats, playing racquets, sticks and mallets are each subject very high intensity impact applied to a fixed or variable point of their playing surface and propagating along an elongated handle that is held by the player. With such implements, while the speed, performance or handling of the striking implement itself maybe relatively unaffected by the impact, the resultant vibration may strongly jar the person holding it. Other sporting equipment, such as sleds, bicycles or skis, may be subjected to extreme impact as well as to diffuse stresses applied over a protracted area and a continuous period of time, and may evolve complex mechanical responses thereto. These responses may excite vibrations or may alter the shape of runners, frame, or chassis structures, or other air- or ground-contacting surfaces. In this case, the vibrations or deformations have a direct impact both on the degree of control which the driver or skier may exert over his path of movement, and on the net speed or efficiency of motion achievable therewith.

Taking by way of example the instance of downhill or slalom skis, basic mechanical considerations have long dictated that this equipment be formed of flexible yet highly stiff material having a slight curvature in the longitudinal and preferably also in the traverse directions. Such long, stiff plate-like members are inherently subject to a high degree of ringing and structural vibration, whether they be constructed of metal, wood, fibers, epoxy or some composite or combination thereof. In general, the location of the skier's weight centrally over the middle of the ski provides a generally fixed region of contact with the ground so that very slight changes in the skier's posture and weight-bearing attitude are effective to bring the various edges and running surfaces of the ski into optimal skiing positions with respect to the underlying terrain. This allows control of steering and travel speed, provided that the underlying snow or ice has sufficient amount of yield and the travel velocity remains sufficiently low. However, the extent of flutter and vibration arising at higher speeds and on irregular, bumpy, icy surfaces can seriously degrade performance. In particular, mechanical vibration leads to an increase in the apparent frictional forces or net drag exerted against the ski by the underlying surface, or may even lead to a loss of control when blade-like edges are displaced so much that they fail to contact the ground. This problem particularly arises with modern skis, and analogous problems arise with tennis racquets and the like made with metals and synthetic materials that may exhibit much higher stiffness and elasticity than wood.

In general, to applicant's knowledge, the only practical approach so far developed for preventing vibration from arising has been to incorporate in a sports article such as a ski, an inelastic material which adds damping to the overall structure or to provide a flexible block device external to the main body thereof. Because of the trade-offs in weight, strength, stiffness and flexibility that are inherent in the approach of adding inelastic elements onto a ski, it is highly desirable to develop other, and improved, methods and structures for vibration control. In particular, it would be desirable to develop a vibration control of light weight, or one that also contributes to structural strength and stiffness so it imposes little or no weight penalty. Other features which would be beneficial include a vibration control structure having broad bandwidth, small volume, ruggedness, and adaptability.

The limitations of the vibrational response of sports implements and equipment other than skis or sleds are somewhat analogous, and their interactions with the environment or effect on the player may be understood, mutatis mutandi. It would be desirable to provide a general solution to the vibrational problem of a sports article. Accordingly, there is a great need for a sports damper.

It should be noted that in the field of advanced structural mechanics, there has been a fair amount of research and experimentation on the possibility of controlling thin structural members, such as airfoils, trusses of certain shapes, and thin skins made of advanced composite or metal material, by actuation of piezoelectric sheets embedded in or attached to these structures. However, such studies are generally undertaken with a view toward modeling an effect achievable with the piezo actuators when they are attached to simplified models of mechanical structures and to specialized driving and monitoring equipment in a laboratory.

In such cases, it is generally necessary to assure that the percentage of strain energy partitioned into the piezo elements from the structural model is relatively great; also in these circumstances, large actuation signals may be necessary to drive the piezo elements sufficiently to achieve the desired control. Furthermore, since the most effective active strain elements are generally available as brittle, ceramic sheet material, much of this research has required that the actuators be specially assembled and bonded into the test structures, and be protected against extreme impacts or deformations. Other, less brittle forms of piezo-actuated material are available in the form of polymeric sheet material, such as PVDF. However, this latter material, while not brittle or prone to cracking is capable of producing only relatively low mechanical actuation forces. Thus, while PVDF is easily applied to surfaces and may be quite useful for strain sensors, its potential for active control of a physical structure is limited. Furthermore, even for piezoceramic actuator materials, the net amount of useful strain is limited by the form of attachment, and displacement introduced in the actuator material is small.

All of the foregoing considerations would seem to preclude any effective application of piezo elements to enhance the performance of a sports implement.

Nonetheless, a number of sports implements remain subject to performance problems as they undergo displacement or vibration, and are strained during normal use. While modem materials have achieved lightness, stiffness and strength, these very properties may exacerbate vibrational problems. It would therefore be desirable to provide a general construction which reduces or compensates for undesirable performance states, or prevents their occurrence in actual use of a sports implement.

SUMMARY OF THE INVENTION

These and other desirable results are achieved in a sports damper in accordance with the present invention wherein all or a portion of the body of a piece of sporting equipment has mounted thereto an electroactive assembly which couples strain across a surface of the body of the sporting implement and alters the damping or stiffness of the body in response to strain occurring in the implement in the area where the assembly is attached. Electromechanical actuation of the assembly adds or dissipates energy, effectively damping vibration as it arises, or alters the stiffness to change the dynamic response of the equipment. The sporting implement is characterized as having a body with a root and one or more principal structural modes having nodes and regions of strain. The electroactive assembly is generally positioned near the root, to enhance or maximize its mechanical actuation efficiency. The assembly may be a passive component, converting strain energy to electrical energy and shunting the electrical energy, thus dissipating energy in the body of the sports implement. In an active embodiment, the system includes an electroactive assembly with piezoelectric sheet material and a separate power source such as a replaceable battery. The battery is connected to a driver to selectively vary the mechanics of the assembly. In a preferred embodiment, a sensing member in proximity to the piezoelectric sheet material responds to dynamic conditions of strain occurring in the sports implement and provides output signals for which are amplified by the power source for actuation of the first piezo sheets. The sensing member is positioned sufficiently close that nodes of lower order mechanical modes do not occur between the sensing member and control sheet. In a further embodiment, a controller may include logic or circuitry to apply two or more different control rules for actuation of the sheet in response to the sensed signals, effecting different actuations of the first piezo sheet.

One embodiment is a ski in which the electroactive assembly is surface bonded to or embedded within the body of the ski at a position a short distance ahead of the effective root location, the boot mounting. In a passive embodiment, the charge across the piezo elements in the assembly is shunted to dissipate the energy of strain coupled into the assembly. In another embodiment, a longitudinally-displaced but effectively collocated sensor detects strain in the ski, and creates an output signal which is used as input or control signal to actuate the first piezo sheet. A single 9-volt battery powers an amplifier for the output signal, and this arrangement applies sufficient power for up to a day or more to operate the electroactive assembly as an active damping or stiffening control mechanism, shifting or dampening resonances of the ski and enhancing the degree of ground contact and the magnitude of attainable speeds. In other sports implements the piezoelectric element may attach to the handle or head of a racquet or striking implement to enhance handling characteristics, feel and performance.

BRIEF DESCRIPTION OF THE DRAWINGS

These and other features of the invention will be understood from the description contained herein taken together with the illustrative drawings, wherein.

DETAILED DESCRIPTION

Figure 1:
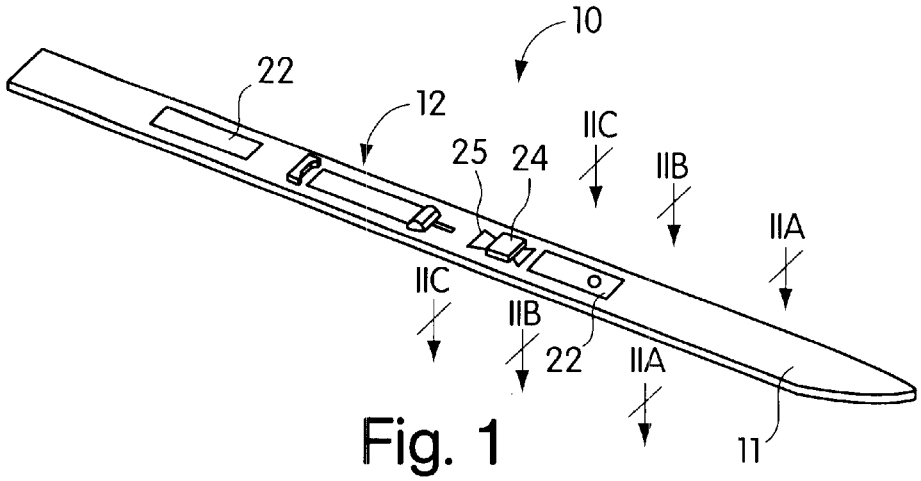
FIG. 1 shows a ski in accordance with the present invention.

FIG. 1 shows by way of example, as an illustrative sports implement, a ski 10 embodying the present invention. Ski 10 has a generally elongated body 11, and mounting portion 12 centrally located along its length, which, for example, in a downhill ski includes one or more ski-boot support plates affixed to its surface, and heel and toe safety release mechanisms (not shown) fastened to the ski behind and ahead of the boot mounting plates, respectively. These latter elements are all conventional, and are not illustrated. It will be appreciated, however, that these features define a plate-mechanical system wherein the weight of a skier is centrally clamped on the ski, and makes this central portion a fixed point (inertially, and sometimes to ground) of the structure, so that the mounting region generally is, mechanically speaking, a root of a plate which extends outwardly therefrom along an axis in both directions. As further illustrated in FIG. 1, ski 10 of the present invention has an electroactive assembly 22 integrated with the ski or affixed thereto, and in some embodiments, a sensing sheet element 25 communicating with the electroactive sheet element. and a power controller 24 in electrical communication with both the sensing and the electroactive sheet elements.

In accordance with applicant's invention, the electroactive assembly and sheet element within are strain-coupled either within or to the surface of ski, so that it is an integral part of and provides stiffness to the ski body, and responds to strain therein by changing its state to apply or to dissipate strain energy, thus controlling vibrational modes of the ski and its response. The electroactive sheet elements 22 are preferably formed of piezoceramic material, having a relatively high stiffness and high strain actuation efficiency. However, it will be understood that the total energy which can be coupled through such an actuator, as well as the power available for supplying such energy, is relatively limited both by the dimensions of the mechanical structure and available space or weight loading, and other factors. Accordingly, the exact location and positioning as well as the dimensioning and selection of suitable material is a matter of some technical importance both for a ski and for any other sports implement, and this will be better understood from the discussion below of specific factors to consider in implementing this sports damper in a ski.

By way of general background, a great number of investigations have been performed regarding the incorporation of thin piezoceramic sheets into stiff structures built up, for example, of polymer material. In particular, in the field of aerodynamics, studies have shown the feasibility of incorporating layers of electroactive material within a thin skin or shell structure to control the physical aspect or vibrational states of the structure. U.S. Pat. Nos. 4,849,648 and 5,374,011 of one or more of the present inventors describe methods of working with such materials, and refer to other publications detailing theoretical and actual results obtained this field.

More recently, applicants have set out to develop and have introduced as a commercial product packaged electroactive assemblies, in which the electroactive material, consisting of one or more thin brittle piezoceramic sheets, is incorporated into a card which may in turn be assembled in or onto other structures to efficiently apply substantially all of the strain energy available in the actuating element. Applicant's published international patent application PCT publication WO 95/20827 describes the fabrication of a thin stiff card with sheet members in which substantially the entire area is occupied by one or more piezoceramic sheets, and which encapsulates the sheets in a manner to provide a tough supporting structure for the delicate member yet allow its in-plane energy to be efficiently coupled across its major faces. That patent application and the aforementioned U.S. Patents are hereby incorporated herein by reference for purposes of describing such materials, the construction of such assemblies, and their attachment to or incorporation into physical objects. Accordingly, it will be understood in the discussion below that the electroactive sheet elements described herein are preferably substantially similar or identical to those described in the aforesaid patent application, or are elements which are embedded in, or supported by sheet material as described therein such that their coupling to the skis provides a non-lossy and highly effective transfer of strain energy therebetween across a broad area actuator surface.

Figure 1A:
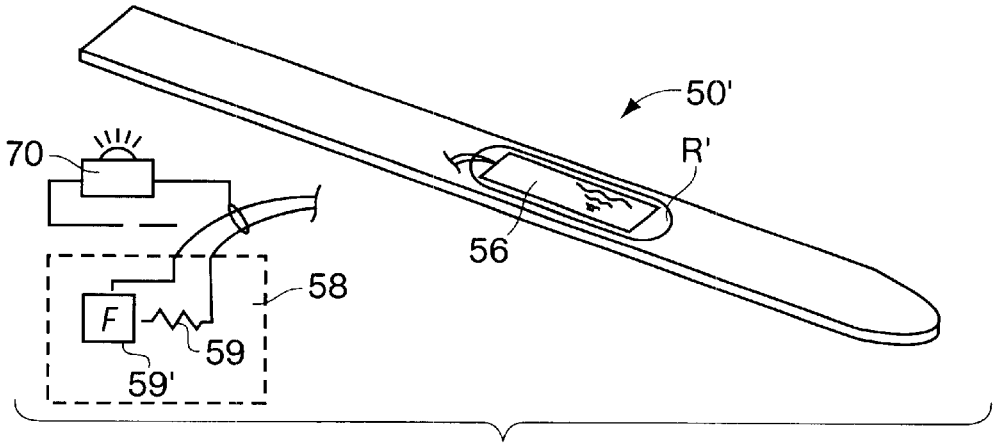
FIGS. 1A and 1C show details of a passive damper embodiment of the ski of FIG. 1.

FIG. 1A illustrates a basic embodiment of a sports implement 50' in accordance with applicant's invention. Here a single sensor/actuator sheet element 56 covers a root region R' of the ski and its strain-induced electrical output is connected across a shunt loop 58. Shunt loop 58 contains a resistor 59 and filter 59' connected across the top and bottom electrodes of the actuator 56, so that as strain in the region R creates charge in the actuator element 56, the charge is dissipated. The mechanical effect of this construction is that strain changes occurring in region R' within the band of filter 59' are continuously dissipated, resulting, effectively, in damping of the modes of the structure. The element 56 may cover five to ten percent of the surface, and capture up to about five percent of the strain in the ski. Since most vibrational states actually take a substantial time period to build up, this low level of continuous mechanical compensation is effective to control serious mechanical effects of vibration, and to alter the response of the ski.

In practice, the intrinsic capacitance of the piezoelectric actuators operates to effectively filter the signals generated thereby or applied thereacross, so a separate filter element 59' need not be provided. In a prototype embodiment, three lead zirconium titanate (PZT) ceramic sheets PZ were mounted as shown in FIG. 1C laminated to flex circuit material in which corresponding trellis-shaped conductive leads C spanned both the upper and lower electroded surfaces of the PZT plates. Each sheet was 1.81 by 1.31 by 0.058 inches, forming a modular card-like assembly approximately 1.66×6.62 inches and 0.066 inches thick. The upper and lower electrode lines C extend to a shunt region S at the front of the modular package, in which they are interconnected via a pair of shunt resistors so that the charge generated across the PZT elements due to strain in the ski is dissipated. The resistors are surface-mount chip resistors, and one or more surface-mount LED's are connected across the leads to flash as the wafers experience strain and shunt the energy thereof. This provides visible confirmation that the circuit lines remain connected. The entire packaged assembly was mounted on the top structural surface layer of a ski to passively couple strain out of the ski body and continuously dissipate that strain. Another prototype embodiment employs four such PZT sheets arranged in a line.

Figure 1B:
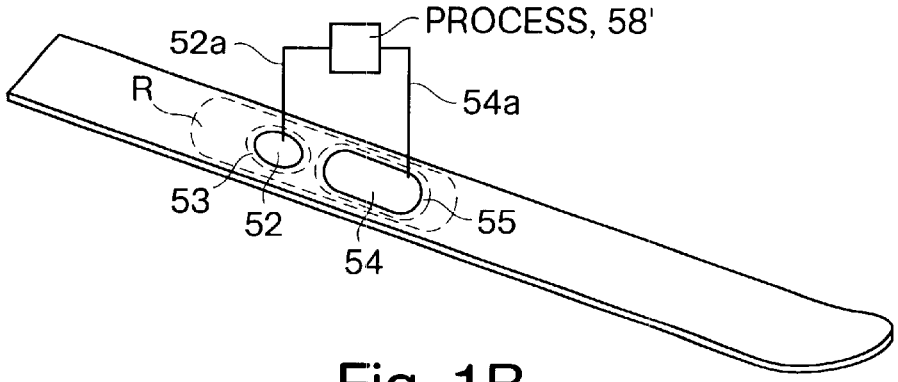
FIG. 1B shows an active embodiment thereof.
Figure 1C:
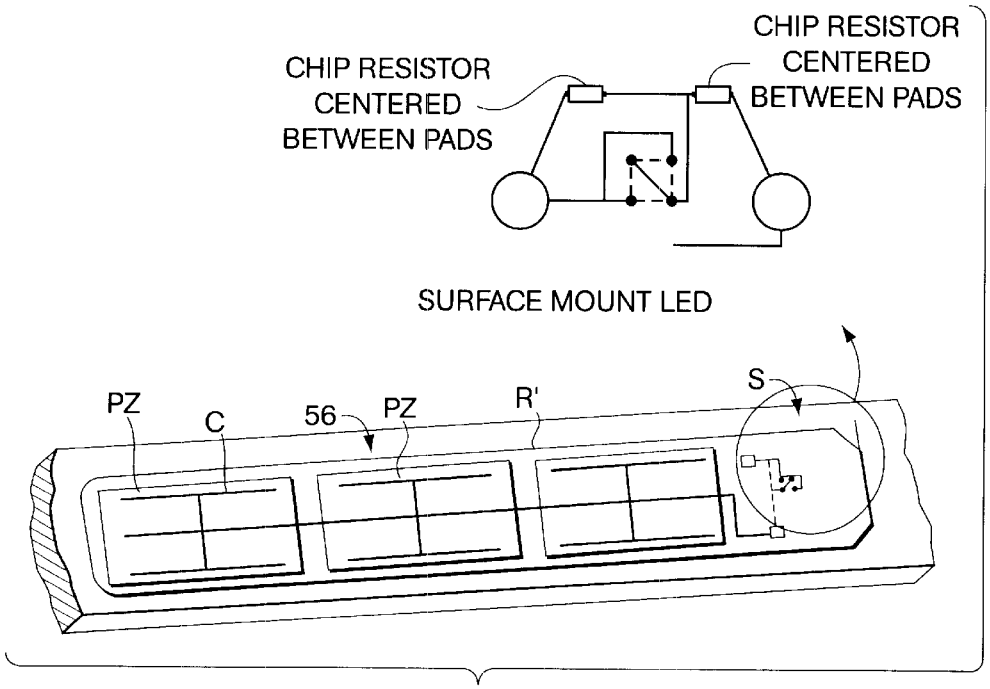

FIG. 1B illustrates another general architecture of a sports implement 50 in accordance with applicant's invention. In this embodiment a first strain element 52 is attached to the implement to sense strain and produce a charge output on line 52*a* indicative of that strain in a region 53 covering all or a portion of a region R, and an actuator strain element 54 is positioned in the region R to receive drive signals on line 54*a* and couple strain into the sports implement over a region 55. Line 52*a* may connect directly to line 54*a*, or may connect via intermediate signal conditioning or processing circuitry 58', such as amplification, phase inversions, delay or integration circuitry, or a microprocessor. As with the embodiment of FIG. 1A, the amount of strain energy achievable by driving the strain element 54 may amount of only a small percentage, e.g., one to five percent, of the strain naturally excited in use of the ski, and this effect might not be expected to result in an observable or useful change in the response of a sports implement. Applicant has found, however that proper selection of the region R and subregions 53 and 55 several effective controls are achieved. A general technique for identifying and determining locations for these regions in a sports implement will be discussed further below.

Figure 1D:
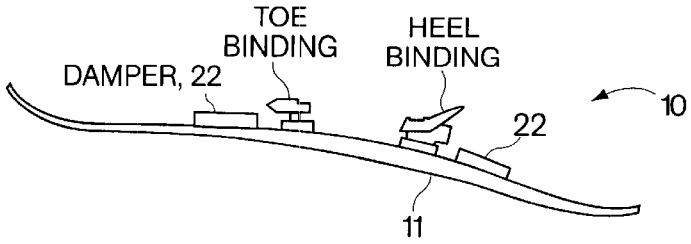
FIG. 1D shows another ski embodiment of the invention.

As further shown in FIG. 1D, other embodiments of an adaptive ski may be implemented having electroactive assemblies 22 located in several regions, both ahead of and behind the root area. This allows a greater portion of the strain energy to be captured, and dissipated or otherwise affected.

Figure 5:
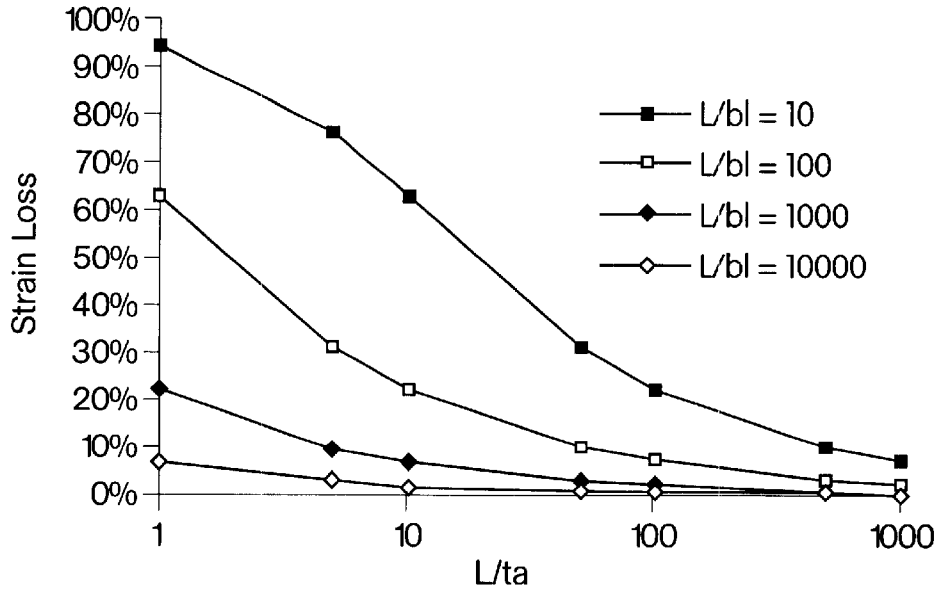
FIG. 5 models strain transfer loss for a glued-on actuator assembly.
Figure 5A:
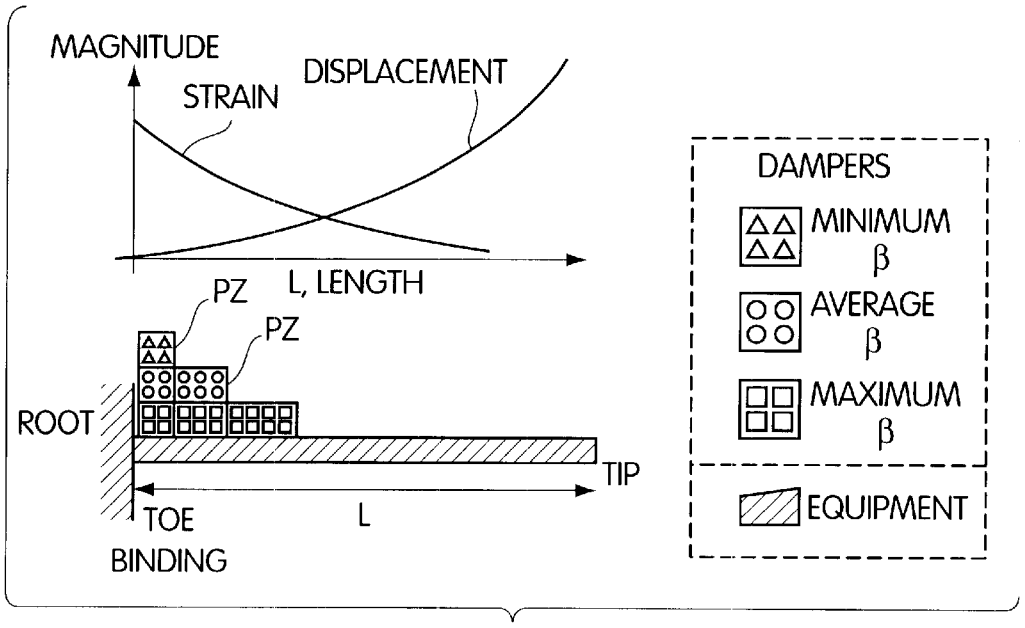
FIG. 5A illustrates one strain actuator placement in relation to strain magnitude.

In general, the amount of strain which can be captured from or applied to the body of the ski will depend on the size and location of the electroactive assemblies, as well as their coupling to the ski. FIG. 5A illustrates strain and displacement along the length of a ski as a function of distance L from the root to the tip. A corresponding construction for the electroactive assembly is illustrated, and shows between one and three layers of strain actuator material PZ, with a greater number of layers in the regions of higher strain. In practice, rather than such a tailored construction, applicant has found that it is adequate to position a relatively short assembly-six or eight inches long-in a region of high strain, where the assembly has a constant number of piezo layers along its length. In prototype embodiments, applicant employed a one-layer assembly for the passive (shunted) damper, and a three-layer assembly for the actively driven embodiment. Such electroactive assemblies of uniform thickness are more readily fabricated in a heated lamination press to withstand extreme physical conditions.

Figure 2A:
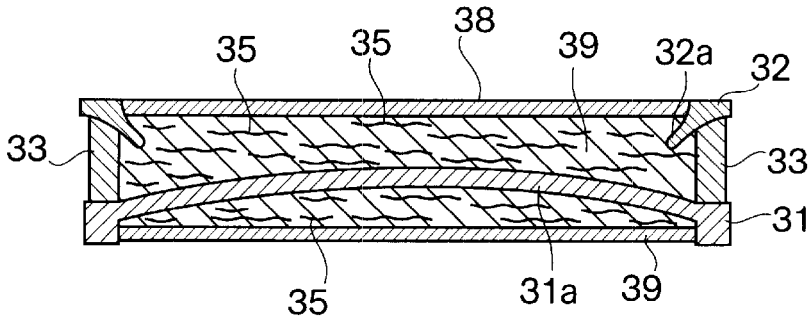
FIGS. 2A–2C shows sections through the ski of FIG. 1.
Figure 2B:
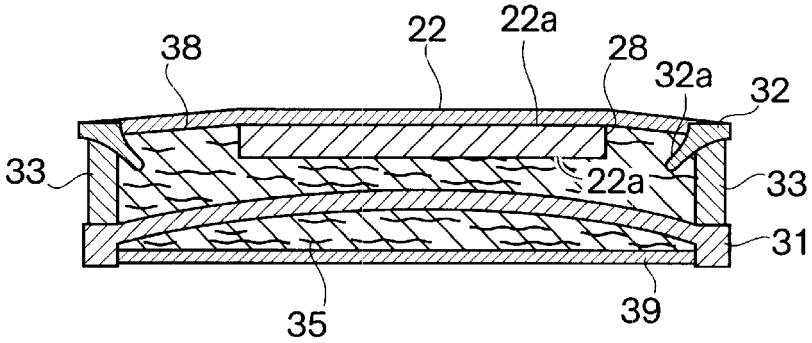
Figure 2C:
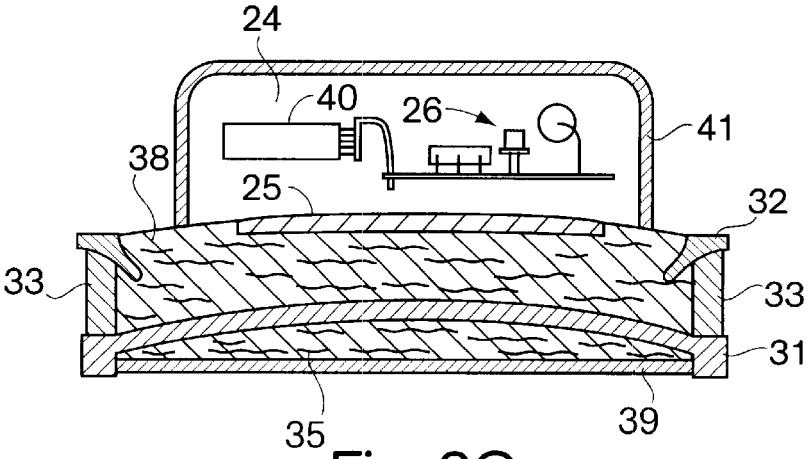

Returning now to the ski shown in FIG. 1, various sections are shown in FIGS. 2A–2C through the forepart of that ski illustrating the cross sectional structure therein. Two types of structures appear. The first are structures forming the body, including runners and other elements, of the ski itself. All of these elements are entirely conventional and have mechanical properties and functions as known in the prior art. The second type of element are those forming or especially adapted to the electroactive sheet elements which are to control the ski. These elements, including insulating films spacers, support structures, and other materials which are laminated about the piezoelectric elements preferably constitute modular or packaged piezo assemblies which are identical to or similar to those described in the aforesaid patent application documents. Advantageously, the latter elements together form a mechanically stiff but strong and laminated flexible sheet. As such they are incorporated into the ski with its normal stiff epoxy or other body material thereof, forming an integral part of the ski body and thereby avoiding any increased weight or performance penalty or loss of strength, while providing the capability for electrical control of the ski's mechanical parameters. This property will be understood with reference to FIGS. 2A–2C.

FIG. 2A shows a section through the forepart of ski 11, in a region where no other mounting or coupling devices are present. The basic ski construction includes a hard steel runner assembly 31 which extends along each side of the ski, and an aluminum edge bead 32 which also extends along each side of the ski and provides a corner element at the top surface thereof. Edge bead 32 may be a portion of an extrusion having projecting fingers or webs 32*a* which firmly anchor and position the bead 32 in position in the body of the ski. Similarly, the steel runner 31 may be attached to or formed as part of a thin perforated sheet structure 31*a* or other metal form having protruding parts which anchor firmly within the body of the skis. The outside edge of the extrusion 32 is filled with a strong non-brittle flowable polymer 33 which serves to protect the aluminum and other parts against weathering and splitting, and the major portion of the body of the ski is filled one or more laminations of strong structural material 35 which may comprise layers of kevlar or similar fabric, fibers of kevlar material, and strong cross-linkable polymer such as an epoxy, or other structural material known in the art for forming the body of the ski. This material 35 generally covers and secures the protruding fingers 32*a* of the metal portion running around the perimeter of the ski. The top of the ski has a layer of generally decorative colored polymer material 38 of low intrinsic strength but high resistance to impact which covers a shallow layer and forms a surface finish on the top of the ski. The bottom of the ski has a similar filled region 39 formed of a low friction polymer having good sliding qualities on snow and ice. In general, the runner 31, edging 32 and structural material 35 form a stiff strong longitudinal plate which rings or resonates strongly in a number of modes when subjected to the impacts and lateral scraping contact impulses of use.

FIG. 2B shows a section taken at position more centrally located along the body of the ski. The section here differs, other than in the slight dimensional changes due to tapering of the ski along its length, in also having an electroactive assembly element 22 together with its supply or output electrode material 22*a* in the body of the ski. As shown in the FIG., the electroactive assembly 22 is embedded below the cover layer 38 of the ski in a recess 28 so that they contact the structural layer 35 over a broad contact area and are directly coupled thereto with an essentially sheer-free coupling. The electrodes connected to the assembly 22 also lie below the surface; this assures that the electroactive assembly is not subject to damage when the skier crosses his skis or otherwise scrapes the top surface of the ski. Furthermore, by placing the element directly in contact with or embedded in the internal structural layer 35, a highly efficient coupling of strain energy thereto is obtained. This provides both a high degree of structural stiffness and support, and the capability to efficiently alter dynamic properties of the ski as a whole. As noted above, in some ski constructions layer 38 tends to be less hard and such a layer 38 would therefore dissipate strain energy that was surface coupled to it without affecting ski mechanics. However, where the top surface is also a stiff polymer, such as a glass/epoxy material, the actuator can be directly cemented to the top surface.

FIG. 2C shows another view through the ski closer to the root or central position thereof. This view shows a section through the power module 24, which is mounted on the surface of the ski, as well as through the sensor 25, which like element 22 is preferably below the surface thereof. As shown, the control or power module 24 includes a housing 41 mounted on the surface and a battery 40 and circuit elements 26 optionally therein, while the electroactive sensor 25 is embedded below the surface, i.e., below surface layer 38, in the body of the ski to detect strain occurring in the region. The active circuit elements 26 may include elements for amplifying the level of signal provided to the actuator and processing elements, for phase-shifting, filtering and switching, or logic discrimination elements to actively apply a regimen of control signals determined by a control law to the electroactive elements 25. In the latter case, all or a portion of the controller circuitry may be distributed in or on the actuator or sensing elements of the electroactive assembly itself, for example as embedded or surface mounted amplifying, shunting, or processing elements as described in the aforesaid international patent application. The actuator element is actuated either to damp the ski, or change its dynamic stiffness, or both. The nature and effect of this operation will be understood from the following.

To determine an effective implementation—to choose the size and placement for active elements as well as their mode of actuation—the ski may first modeled in terms of its geometry, stiffness, natural frequencies, baseline damping and mass distribution. This model allows one to derive a strain energy distribution and determine the mode shape of the ski itself. From these parameters one can determine the added amount of damping which may be necessary to control the ski. By locating electroactive assemblies at the regions of high strain, one can maximize the percentage of strain energy which is coupled into a piezoceramic element mounted on the ski for the vibrational modes of interest. In general by covering a large area with strain elements, a large portion of the strain energy in the ski can be coupled into the electroactive elements. However, applicant has found it sufficient in practice to deal with lower order modes, and therefore to cover less than fifty percent of the area forward of toe area with actuators. In particular, from the strain energy distribution of the modes of concern, for example the first five or ten vibrational modes of the ski structure, the areas of high strain may be determined. The region for placement of the damper is then selected based on the strain energy, subject to other allowable placement and size constraints. The net percent of strain energy in the damper may be calculated from the following equation:

$$\%SE_d=(EI_d/EI_S)*\%SE_S(\text{in damper region})*\beta \quad (1)$$

By multiplying this number by the damping factor of the electroactive assembly configured for damping, the damping factor for the piece of equipment is found.

$$\eta_s=\eta_d*\%SE_d \quad (2)$$

Figure 3:
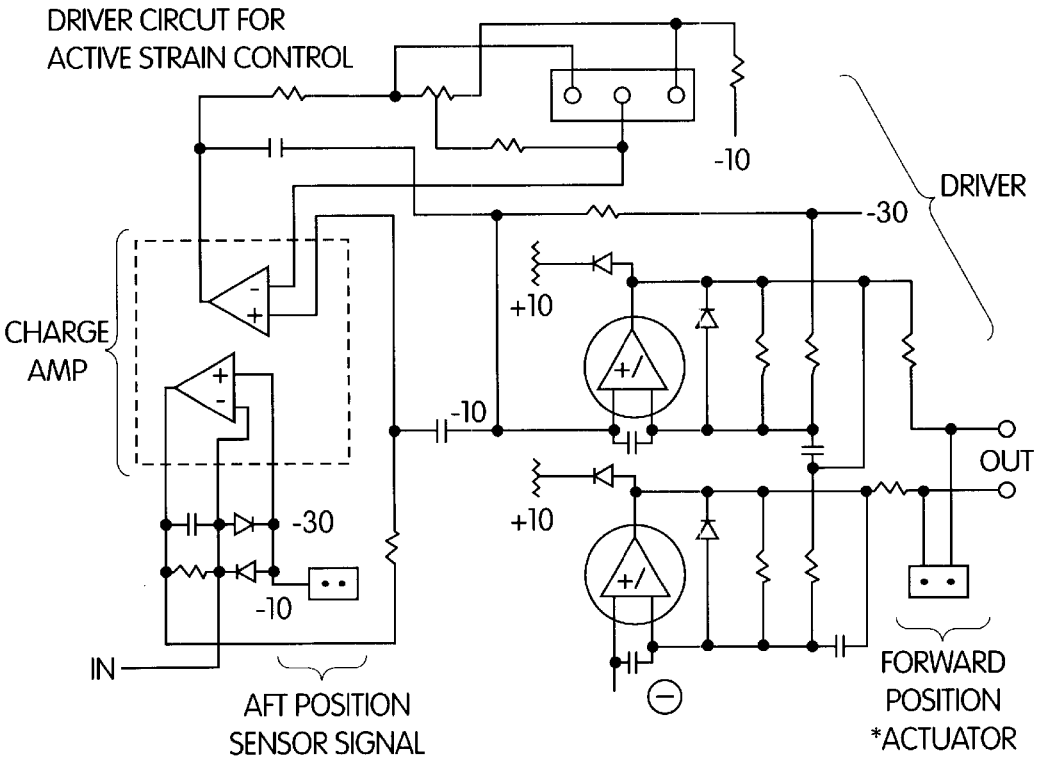
FIG. 3 schematically shows a circuit for driving the ski of FIG. 1B.
Figure 4:
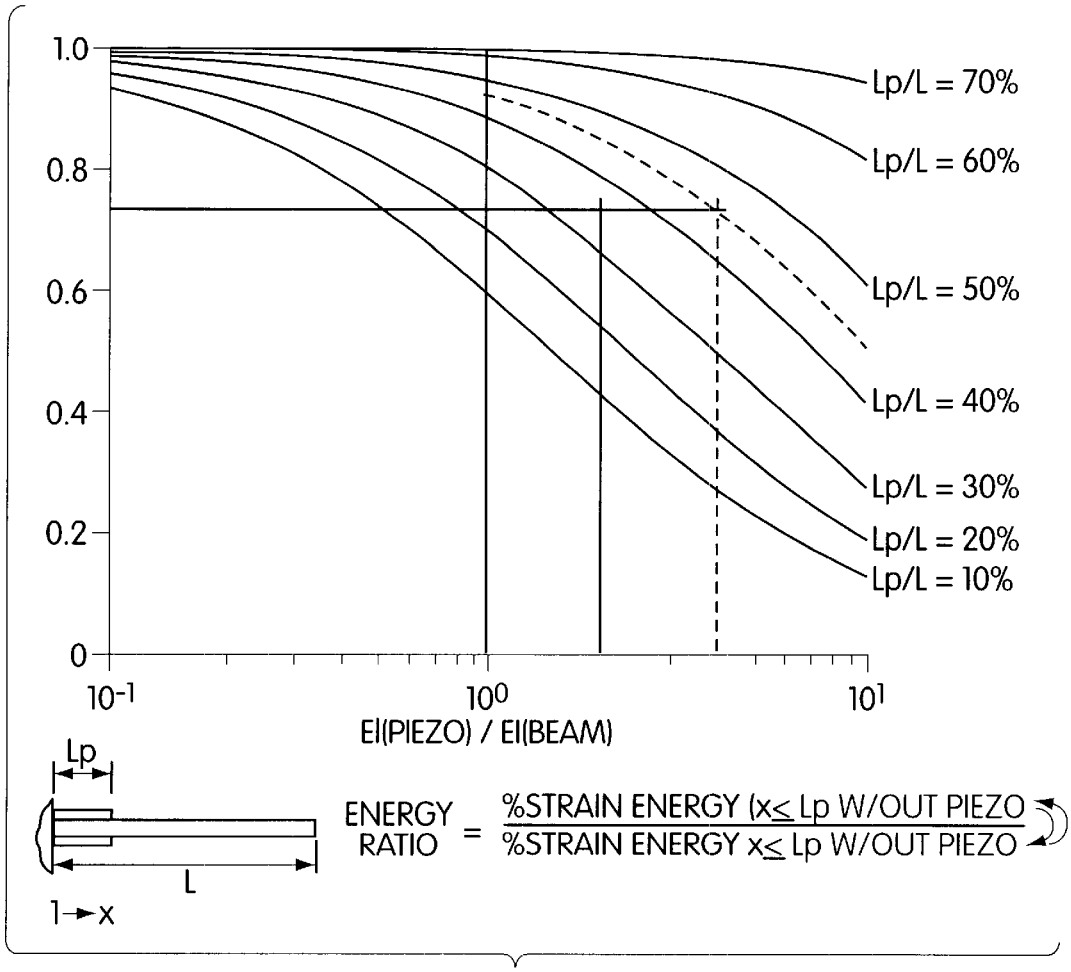
FIG. 4 models energy ratio for actuators of different lengths.

The other losses β are a function of (a) the relative impedance of the piece of equipment and the damper $[EI_d/EI_s]$ and (b) the thickness and strength of the bonding agent used to attach the damper. Applicant has calculate impedance losses using FEA models, and these are due to the redistribution of the strain energy which results when the damper is added. A loss chart for a typical application is shown in FIG. 3. Bond losses are due to energy being absorbed as shear energy in the bond layers between actuator and ski body, and are found by solving the differential equation associated with strain transfer through material with significant shearing. The loss is equal to the strain loss squared and depends on geometric parameters as shown in FIG. 4. The losses β have the effect of requiring the damper design to be distributed over a larger area, rather than simply placing the thickest damper on the highest strain area. This effect is shown in FIG. 5.

The damping factor of the damper depends on its dissipation of strain energy. In the passive construction of FIG. 1A, dissipation is achieved with a shunt circuit attached to the electroactive elements. Typically, the exact vibrational frequencies of a sports implement are not known or readily observable due to the variability of the human using it and the conditions under which it is used, so applicant has selected a broad band passive shunt, as opposed to a narrow band tuned-mass-damper type shunt. The best such shunt is believed to be just a resistor tuned in relation to the capacitance of the piezo sheet, to optimize the damping in the damper near the specific frequencies associated with the modes to be damped. The optimal shunt resistor is found from the vibration frequency and capacitance of the electroactive element as follows:

$$R_{opt}=al*(1/(\omega c)) \quad (3)$$

where the constant al depends on the coupling coefficient of the damping element.

In a prototype employing a piezoceramic damper module as described in the above-referenced patent application, the shunt circuit is connected to the electroactive elements via flex-circuits which, together with epoxy and spacer material, form an integral damper assembly. Preferably an LED is placed across the actuator electrodes, or a pair of LEDs are placed across legs of a resistance bridge to achieve a bipolar LED drive at a suitable voltage, so that the LED flashes to indicate that the actuator is strained and shunting, i.e., that the damper is operating. This configuration is shown in FIG. 1A by LED 70.

In general, when an LED indicator is connected, typically through a current-limiting resistor, to the electrodes contacting one or more of piezoceramic plates in the damper assembly, the LED will light up when there is strain in the plates. Thus, as an initial matter, illumination of the LED indicates that the piezo element electrodes remain attached, demonstrating the integrity of the piezo vibration control module. The LED will flash ON and OFF at the frequency of the disturbance that the ski is experiencing; in addition, its brightness indicates the magnitude of the disturbance. In typical ski running conditions—that is when the terrain varies and there are instants of greater or lesser energy coupling and build-up in the ski, the amount of damping imparted to the ski is discernible by simply observing the amount of time it takes for the LED illumination to decay. The sooner the light stops flashing, the higher the level of damping. Damage to the module is indicated if the LED fails to illuminate when the ski is subject to a disturbance, and particular defects, such as a partially-broken piezo plate, may be indicated by a light output that is present, but weak. A break in the electrical circuit can be deduced when the light intermittently fails to work, but is sometimes good. Other conditions, such as loss of a fundamental mode indicative of partial internal cracking of the ski or implement, or shifting of the spectrum indicative of loosening or Aging of materials, may be detected.

In addition to the above indications provided by the LED illumination, which apply to many sports implement embodiments of the invention, the LED in a ski embodiment may provide certain other useful information or diagnostics of skiing conditions or of the physical condition of the ski itself. Thus, for instance, when skiing on especially granular hard chop, the magnitude and type of energy imparted to the ski-which a skier generally hears and identifies by its loud white noise "swooshing" sound—may give rise to particular vibrations or strain identifiable by a visible low-frequency blinking, or a higher frequency component which, although its blink rate is not visible, lies in an identifiable band of the power spectrum. In this case, the ski conditions may all be empirically correlated with their effects on the strain energy spectrum and one or more band pass filters may be provided at the time of manufacture, connected to LEDs that light up specifically to indicate the specific snow condition. Similarly, a mismatch between snow and the ski running surface may result in excessive frictional drag, giving rise, for example, to Rayleigh waves or shear wave vibrations which are detected at the module in a characteristic pattern (e.g. a continuous high amplitude strain) or frequency band. In this case by providing an appropriate filter to pass this output to an LED, the LED indicates that a particular remedial treatment is necessary—e.g. a special wax is necessary to increase speed or smoothness. The invention also contemplates connecting the piezo to a specific LED via a threshold circuit so that the LED lights up only when a disturbance of a particular magnitude occurs, or a mode is excited at a high amplitude.

Figure 6:
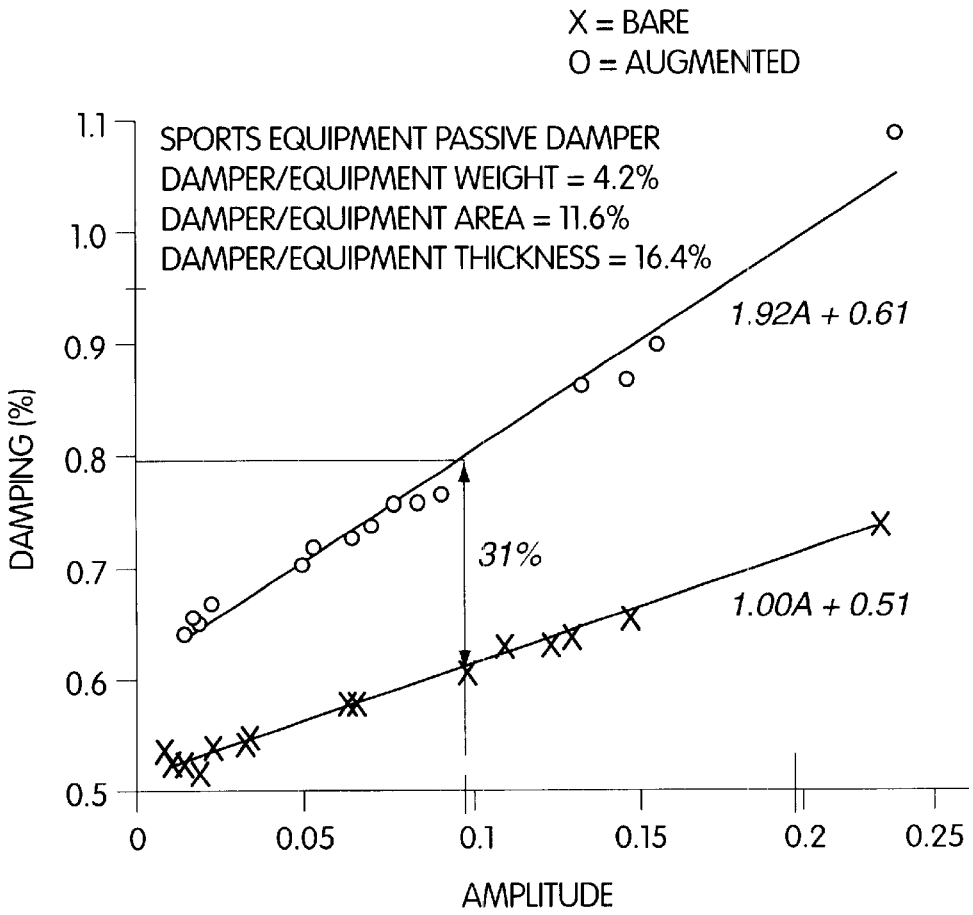
FIG. 6 shows damping achieved with a passive shunt embodiment.
Figure 6A:
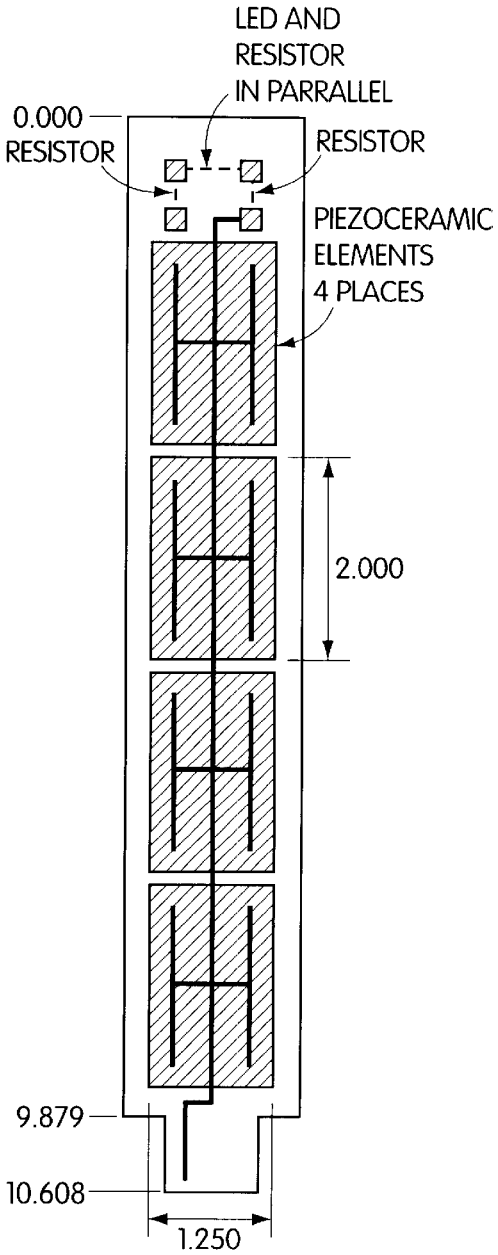
FIG. 6A illustrates the actuator assembly for the embodiment of FIG. 6.

A prototype embodiment of the sports damper for a downhill ski as shown in FIG. 1A was constructed. Damping measurements on the prototype, with and without the damper, were measured as shown in FIG. 6. The damper design added only 4.2% in weight to the ski, yet was able to add 30% additional damping. The materials of which the ski was manufactured were relatively stiff, so the natural level of damping was below one percent. The additional damping due to a shunted piezoelectric sheet actuator amounted to about one-half to one percent damping, and this small quantitative increase was unexpectedly effective to decrease vibration and provide greater stability of the ski. The aforesaid design employed electroactive elements over approximately 10% of the ski surface, with the elements being slightly over 1/16th of an inch thick, and, as noted, it increased the level of damping by a factor of approximately 30%. This embodiment did not utilize a battery power pack, but instead employed a simple shunt resistance to passively dissipate the strain energy entering the electroactive element. FIG. 6A shows the actuator layout with four 1¼"×2" sheets attached to the toe area.

A prototype of the active embodiment of the invention was also made. This employed an active design in which the element could be actuated to either change the stiffness of the equipment or introduce damping. The former of these two responses is especially useful for shifting vibrational modes when a suitable control law has been modeled previously or otherwise determined, for effecting dynamic compensation. It is also useful for simply changing the turning or bending resistance, e.g. for adapting the ski to perform better slalom or mogul turns, or alternatively grand slalom or downhill handling. The active damper employed a battery power pack as illustrated in FIGS. 1B and 2, and utilized a simply 9-volt battery which could be switched ON to power the circuitry. Overall the design was similar to that of the passive damper, with the actuator placed in areas of high strain for the dynamic modes of interest. Typically, only the first five or so structural modes of the ski need be addressed, although it is straightforward to model the lowest fifteen or twenty modes. Impedance factors and shear losses enter into the design as before, but in general, the size of actuators is selected based on the desired disturbance force to be applied rather than the percent of strain energy which one wishes to capture, taking as a starting point that the actuator will need enough force to move the structure by about fifty percent of the motion caused by the average disturbance (i.e., to double the damping or stiffness). The actuator force can be increased either by using a greater mass of active piezo material, or by increasing the maximum voltage generated by the drive amplifier. Thus there is a trade-off in performance with power consumption or with the mass of the electroactive material. Rather than achieve full control, applicant therefore undertook to optimize the actuator force in this embodiment, subject to practical considerations of size, weight, battery life and cost constraints. This resulted in a prototype embodiment of the active, or powered, damper as follows.

Figure 7:
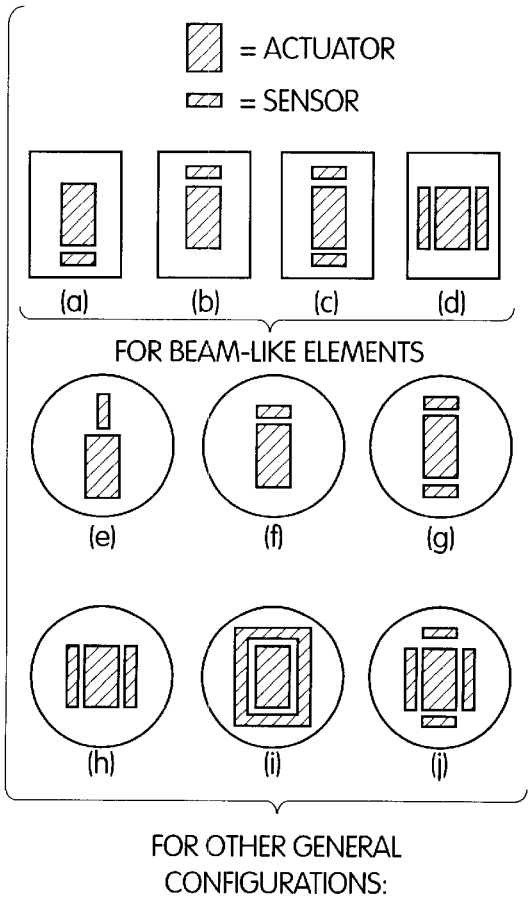
FIGS. 7(*a*)–7(*j*) show general actuator/sensor configurations adapted for differently shaped sports implements.

The basic architecture employed a sensor to sense strain in the ski, a power amplifier/control module and an actuator which is powered by the control module, as illustrated in FIG. 1B. Rather than place the sensor inside the local strain field of the actuator so that it directly senses strain occurring at or near the actuator, applicant placed the sensor outside of the strain field but not so far away that any nodes of the principal structural modes of the ski would appear between the actuator and the sensor. Applicant refers to such a sensor/actuator placement, i.e., located closer to the actuator than the strain nodal lines for primary modes, as an "interlocated" sensor. The sensor "s" may be ahead of, behind, both ahead of and behind, or surrounding the actuator "a", as illustrated in the schematic FIG. 7(*a*)–(*j*). In one practical embodiment, the actuator itself was positioned at the point on the ski where the highest strains occur in the modes of interest. For a commercially available ski, the first mode had its highest strain directly in front of the boot. However, in building the prototype embodiment, to accommodate constraints on available placement locations, applicant placed the actuator several inches further forward in a position where it was still able to capture 2.4% of the total strain energy of the first mode. An interlocated sensor was then positioned closer to the boot to sense strain at a position close enough to the actuator that none of the lower frequency mode strain node lines fell between the sensor and the actuator. As a control driving arrangement, this combination produced a pair of zeros at zero Hertz (AC coupling) and an interlaced pole/zero pattern up to the first mode which has strain node line between the sensor and actuator. The advantage of this arrangement is that when a controller with a single low frequency pole (e.g., a band limited integrator) is combined with the low frequency pair of zeros, a single zero is left to interact with the flexible dynamics of the ski. This single zero effectively acts as rate feedback and damping. However, since the control law itself is an integrator, it is inherently insensitive to high frequency noise and no additional filtering is needed. The absence of filter eliminates the possibility of causing a high frequency instability, thus assuring that, although incompletely modeled and subject to variable boundary conditions, the active ski has no unexpected instability.

For this ski, it was found that placing the sensor three to four inches away from the actuator and directly in front of the binding produce the desired effect. A band limited integrator with a corner frequency of 5 Hz., well below the first mode of the ski at 13 Hz. was used as a controller. The controller gain could be varied to induce anywhere from 0.3% to 2% of active damping. The limited power available from the batteries used to operate the active control made estimation of power requirements critical. Conservative estimates were made assuming the first mode was being excited to a high enough level to saturate the actuators. Under this condition, the controller delivers a square wave of amplitude equal to the supply voltage to a capacitor. The power required in this case is:

$$P = \frac{\omega c v^2}{\pi}$$

where C is the actuator capacitance and ω is the modal frequency in radians per second.

The drive was implemented as a capacitance charge pump having components of minimal size and weight and being relatively insensitive to vibration, temperature, humidity, and battery voltage. A schematic of this circuit is shown in FIG. 3. The active control input was a charge amplifier to which the small sensing element could be effectively coupled at low frequencies. The charge amp and conditioning electronics both run off lower steps on the charge pump ladder than the actual amplifier output, to keep power consumption of this input stage small. Molded axial solid tantalum capacitors where used because of their high mechanical integrity, low leakage, high Q, and low size and weight. An integrated circuit was used for voltage switching, and a dual FET input op amp was used for the signal processing. The output drivers were bridged to allow operation from half the supply voltage thus conserving the supply circuitry and power. Resistors were placed at the output to provide a stability margin, to protect against back drive and to limit power dissipation. Low leakage diodes protected the charge amp input from damage. These latter circuit elements function whether the active driving circuit is ON or OFF, a critical feature when employing piezoceramic sensors that remain connected in the circuitry. An ordinary 9-volt clip-type transistor radio battery provided power for the entire circuit, with a full-scale drive output of 30–50 volts.

Figure 8:
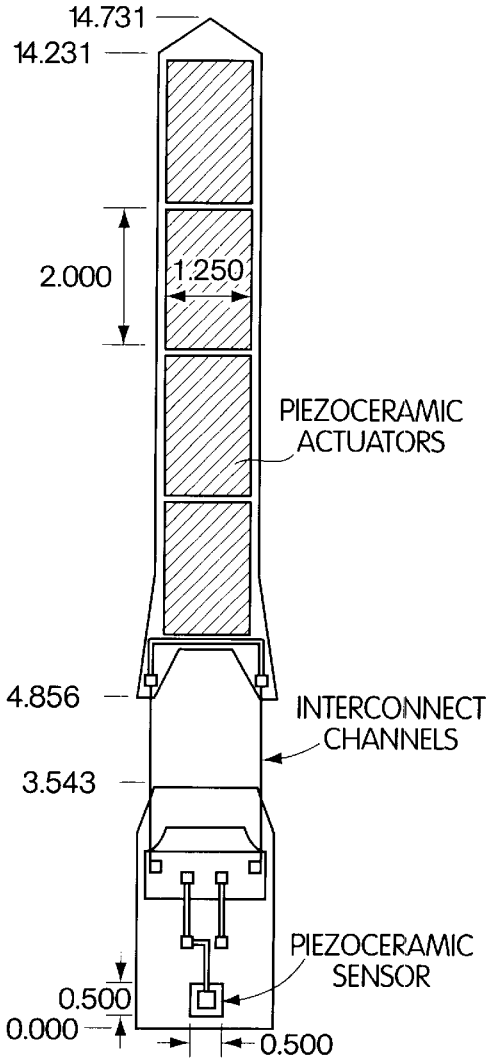
FIG. 8 shows an actuator/circuit/sensor layout in a prototype active embodiment.
Figure 8A:
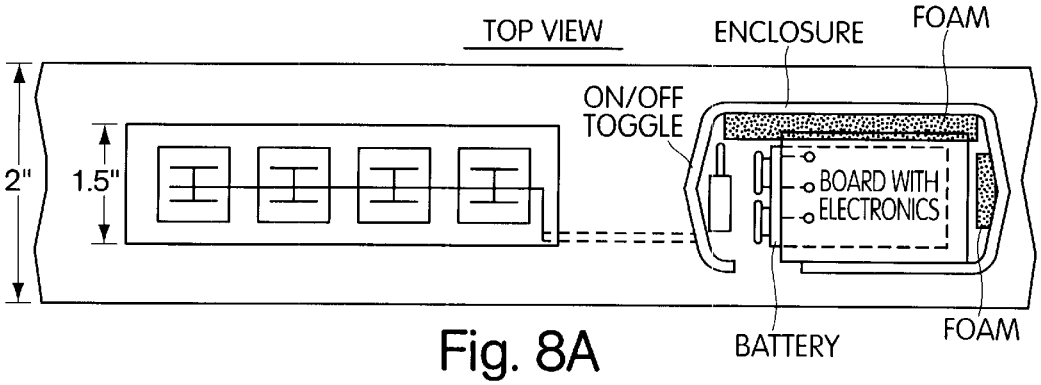
FIGS. 8A and 8B show top and sectional views of the assembly of FIG. 8 mounted in a ski.
Figure 8B:
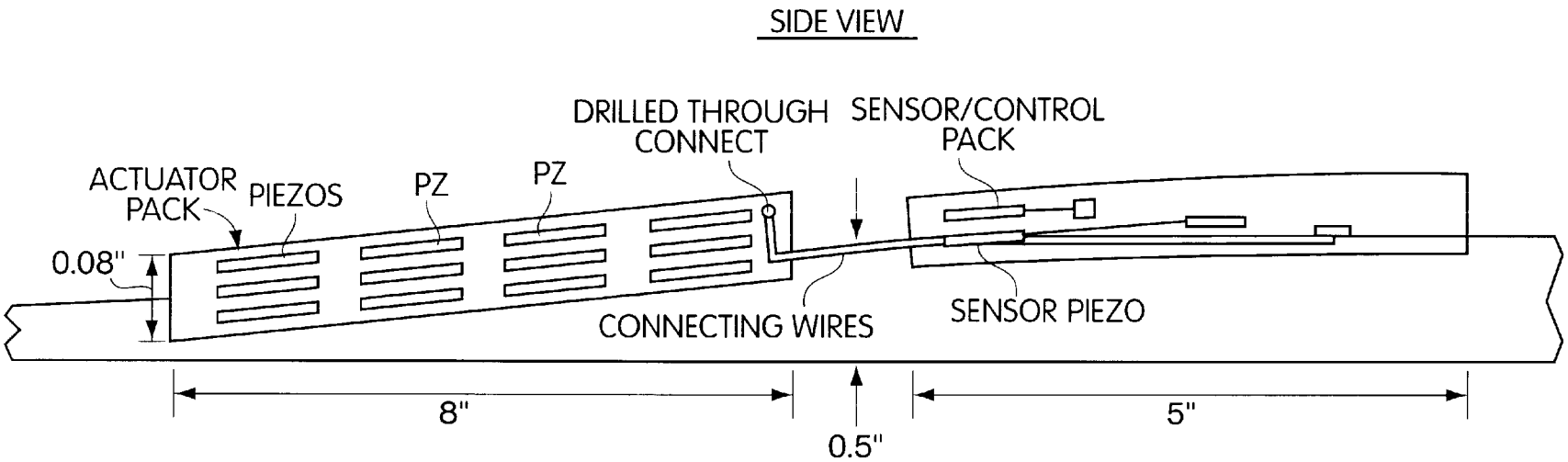

Layout of the actuator/sensor assembly of the actively-driven prototype is shown in FIGS. 8, 8A and 8B. An actuator similar in construction and dimensions to that of FIG. 6A was placed ahead of the toe release, and lead channels were formed in the ski's top surface to carry connectors to a small interlocated piezoceramic strain sensor, which was attached to the body of the ski below the power/control circuit box, shown in outline. The electroactive assembly included three layers each containing four PZT wafers and was embedded in a recess approximately two millimeters deep, with its lower surface directly bonded to the uppermost stiff structural layer within the ski's body. The provision of three layers in the assembly allowed a greater amount of strain energy to be applied.

Field testing of the ski with the active damper arrangement provided surprising results. Although the total amount of strain energy was under five percent of the strain energy in the ski, the damping affect was quite perceptible to the skiers and resulted in a sensation of quietness, or lack of mechanical vibration that enhanced the ski's performance in terms of high speed stability, turning control and comfort. In general, the effect of this smoothing of ski dynamics is to have the running surfaces of the ski remain in better contact with the snow and provide overall enhanced speed and control characteristics.

The prototype embodiment employed approximately a ten square inch actuator assembly arrayed over the fore region of a commercial ski, and was employed on skis having a viscoelastic isolation region that partially addressed impact vibrations. Although the actuators were able to capture less than five percent of the strain energy, the mechanical effect on the ski was very detectable in ski performance.

Greater areas of actuator material could be applied with either the passive or the active control regimen to obtain more pronounced damping affects. Furthermore, as knowledge of the active modes a ski becomes available, particular switching or control implementation may be built into the power circuitry to specifically attack such problems as resonant modes which arise under particular conditions, such as hard surface or high speed skiing.

The actuator is also capable of selectively increasing vibration. This may be desirable to excite ski modes which correspond to resonant undulations that may in certain circumstances reduce frictional drag of the running surfaces. It may also be useful to quickly channel energy into a known mode and prevent uncontrolled coupling into less desirable modes, or those modes which couple into the ski shapes required for turning.

In addition to the applications to a ski described in detail above, the present invention has broad applications as a general sports damper which may be implemented by applying the simple modeling and design considerations as described above. Thus, corresponding actuators may be applied to the runner or chassis of a luge, or to the body of a snowboard or cross country ski. Furthermore, electroactive assemblies may be incorporated as portions of the structural body as well as active or passive dampers, or to change the stiffness, in the handle or head of sports implements such as racquets, mallets and sticks for which the vibrational response primarily affects the players' handling rather than the object being struck by the implement. It may also be applied to the frame of a sled, bicycle or the like. In each case, the sports implement of the invention is constructed by modeling the modes of the sports implement, or detecting or determining the location of maximal strain for the modes of interest, and applying electroactive assemblies material at the regions of high strain, and shunting or energizing the material to control the device.

Rather than modeling vibrational modes of a sports implement to determine an optimum placement for a passive sensor/actuator or an active actuator/sensor pair, the relevant implement modes may be empirically determined by placing a plurality of sensors on the implement and monitoring their responses as the implement is subjected to use. Once a "map" of strain distribution over the implement and its temporal change has been compiled, the regions of high strain are identified and an actuator is located, or actuator/sensor pair interlocated there to affect the desired dynamic response.

A ski interacts with its environment by experiencing a distributed sliding contact with the ground, an interaction which applies a generally broad band excitation to the ski. This interaction and the ensuing excitation of the ski may be monitored and recorded in a straightforward way, and may be expected to produce a relatively stable or slowly evolving strain distribution, in which a region of generally high strain may be readily identified for optional placement of the electroactive assemblies. A similar approach may be applied to items such as bicycle frames, which are subject to similar stimuli and have similarly distributed mechanics.

An item such as mallet or racquet, on the other hand, having a long beam-like handle and a solid or web striking face at the end of the handle, or a bat with a striking face in the handle, generally interacts with its environment by discrete isolated impacts between a ball and its striking face. As is well known to players, the effect of an impact on the implement will vary greatly depending on the location of the point of impact. A ball striking the "sweet spot" of a racquet or bat will efficiently receive the full energy of the impact, while a glancing or off-center hit with a bat or racquet can excite a vibrational mode that further reduces the energy of the hit and also makes it painful to hold the handle. For these implements, the discrete nature of the exciting input makes it possible to excite many longitudinal modes with relatively high energy. Furthermore, because the implement is to be held at one end, the events which require damping for reasons of comfort, will in general have high strain fields at or near the handle, and require placement of the electroactive assembly in or near that area. However, it is also anticipated that a racquet may also benefit from actuators placed to damp circumferential modes of the rim, which may be excited when the racquet nicks a ball or is impacted in an unintended spot. Further, because any sports implement, including a racquet, may have many excitable modes, controlling the dynamics may be advantageous even when impacted in the desired location. Other sports implements to which actuators are applied may include luges or toboggans, free-moving implements such as javelins, poles for vaulting and others that will occur to those skilled in the art.

Figure 9:
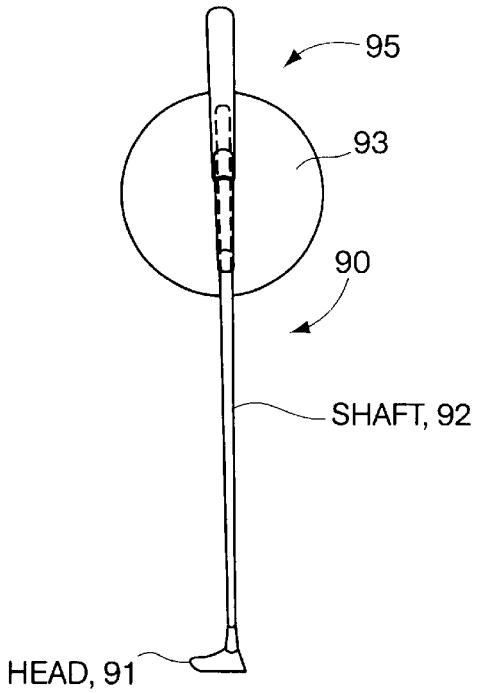
FIG. 9 shows a golf club embodiment of the invention.
Figure 9A:
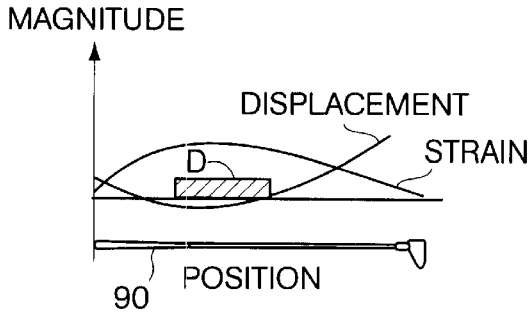
FIG. 9A illustrates strain characteristics thereof.
Figure 9B:
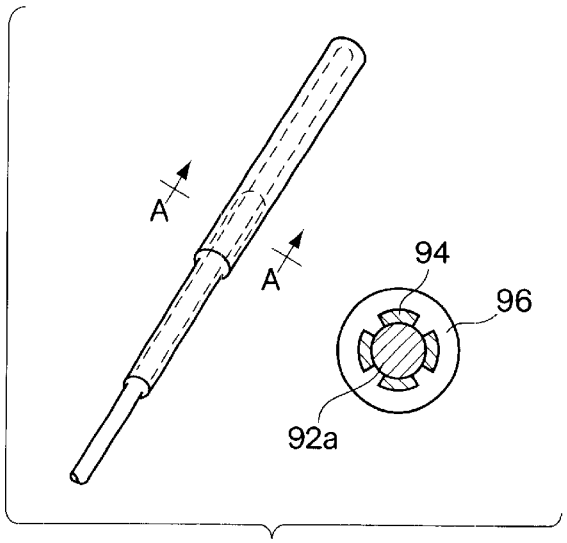
FIG. 9B shows details thereof in sectional view.

FIG. 9 illustrates a golf club embodiment 90 in accordance with the present invention. Club 90 includes a head 91, an elongated shaft 92, and a handle assembly 95 with an actuator region 93. FIG. 9A shows the general distribution of strain and displacement experienced by the club upon impact, e.g. those of the lowest order longitudinal mode, somewhat asymmetric due to the characteristic mass distribution and stiffness of the club, and the user's grip which defines a root of the assembly. In this embodiment an electroactive assembly is positioned in the region 93 corresponding to region "D" (FIG. 9A) of high strain near the lower end of the handle. FIG. 9B illustrates such a construction. As shown in cross-section, the handle assembly 95 includes a grip 96 which at least in its outermost layers comprises a generally soft cushioning material, and a central shaft 92*a* held by the grip. A plurality of arcuate strips 94 of the electroactive assembly are bonded to the shaft and sealed within a surrounding polymer matrix, which may for example be a highly cross-linked structural epoxy matrix which is hardened in situ under pressure to maintain the electroactive elements 94 under compression at all times. As in the ski embodiment of FIG. 1A, the elements 94 are preferably shunted to dissipate electrical energy generated therein by the strain in the handle.

The actuators may also be powered to alter the stiffness of the club. In general, hen applied to affect damping, increased damping will reduce the velocity component of he head resulting from flexing of the handle, while reduced damping will increase the attainable head velocity at impact. Similarly, by energizing the actuators to change the stiffness, the "timing" of shaft flexing is altered, affecting the maximum impact velocity or transfer of momentum to a struck ball.

Figure 9C:
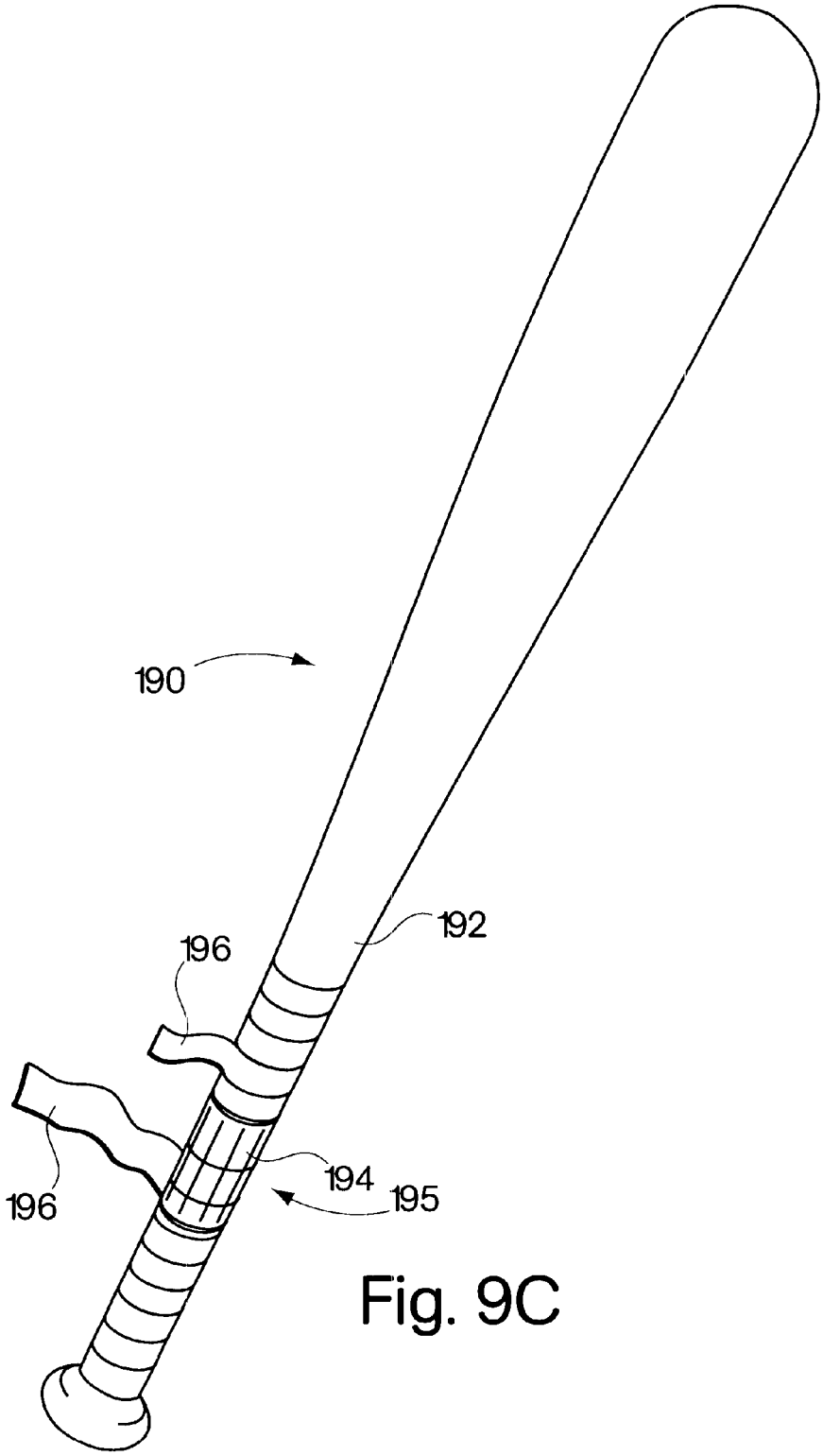
FIG. 9C shows a baseball bat embodiment of the invention.

FIG. 9C illustrates a baseball bat construction 190 of the present invention. As in the golf club embodiment, the electroactive material 194 is positioned around the circumference of the handle region 195 and bonded to the body 192. A cushioning wrap 196 surrounds the handle portion, and serves to protect the material 194 from damaging impact, to reduce the transmission of shock to the batter's hands and to provide additional damping. As shown above for the golf club and ski embodiments, the electroactive material 194 preferably comprises a layer of material such as a stiff piezoceramic material sealed between electroded sheets, and is shunted to dissipate the vibrational energy which enters the electroactive material when the body 192 is struck. In this construction shunt and other circuit elements may be conveniently fitted inside the handle of the bat, where they are fully protected and do not impair the balance and strength of the bat.

To demonstrate the efficacy of such an electroactive damping arrangement, applicant undertook to construct a baseball bat having a damping assembly as described. A metal (e.g. aluminum) bat was used in a prototype embodiment, and provided a stiffness which was mechanically well matched to the electroactive material, a piezoceramic, which was employed in the damper. Applicant determined the vibrational response of the bat and optimized the shunt circuitry and configured the damping assembly to operate most effectively at the most prominent vibrations, with the electroactive material being positioned in an assembly bonded to the bat body in a position near the handle.

Figure 13A:
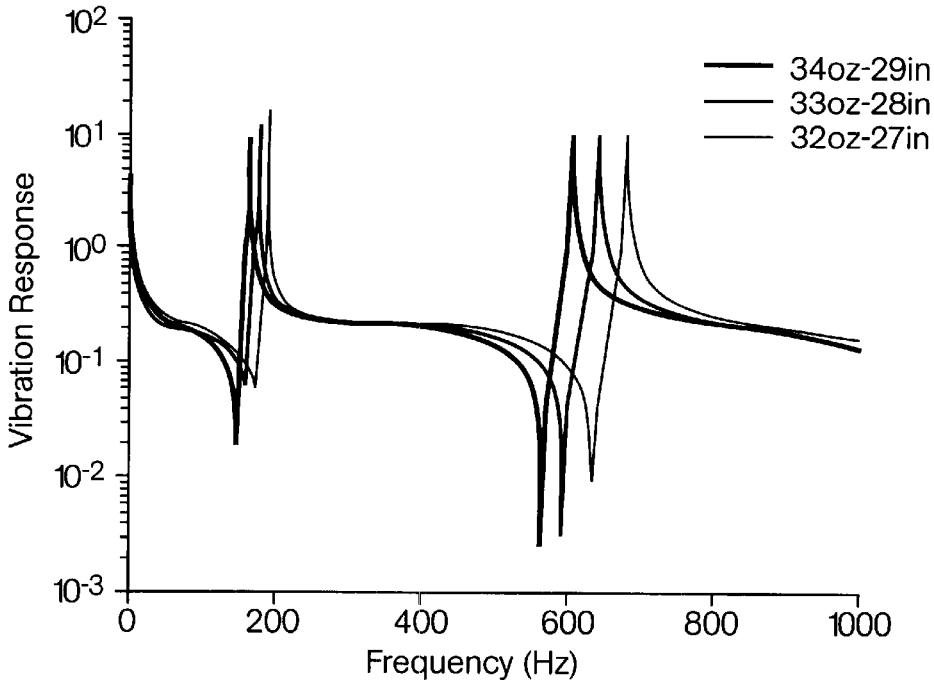
FIGS. 13A and 13B illustrate baseball bat response characteristics.
Figure 13B:
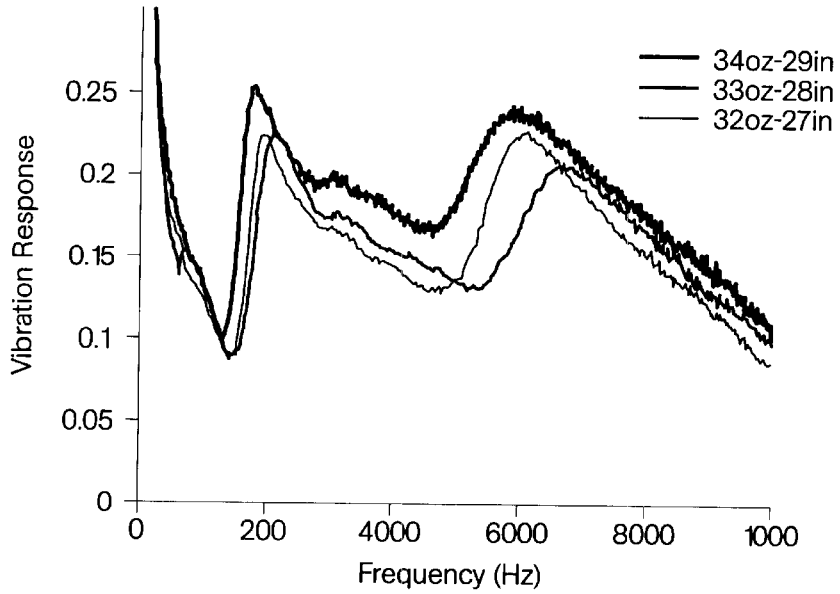

FIG. 13A shows the vibrational response to stimulation as measured in three bats, which were freely suspended, and had lengths of 27, 28 and 29 inches. As shown, each bat had a first pronounced resonance in the range of 160 to 200 Hz, and a second resonance in the range of 550 to 750 Hz, with the longer bats having their resonances shifted toward a lower frequency. FIG. 13B shows the corresponding response curves when each bat was hand held. Holding the bat smoothed the response somewhat from its initial highly-defined or sharp metallic resonance. The peaks, however, remain well-defined and of high amplitude, indicating a great deal of vibrational energy in these two frequency bands.

Accordingly, applicant undertook to capture and remove strain energy in those resonance bands by configuring the electroactive material to contact the bat over a surface area for receiving strain energy, and placing a tuned shunt circuit across the material to act with enhanced effect at the target frequency. A practical method of achieving this is described in commonly owned earlier filed U.S. patent application Ser. No. 08/797,004, filed on Feb. 7, 1997 and entitled Adaptive Sports Implement with Tuned Damping, and further in international application PCT/US98/02132, to which reference is made for general mechanical and circuit considerations involved in enhancing strain energy dissipation of structural vibration. That patent application, together with it's corresponding international application filed on Feb. 6, 1998 in the United States PCT Receiving Office are hereby incorporated by reference for purposes of such disclosure. As will be understood from FIGS. 13A and 13B, a substantial amount of damping, above about 0.001, is necessary to remove or substantially diminish the observed peaks. Moreover, this level of damping is to be obtained for each of two widely separated resonances, both of which, moreover, may occur in slightly different regions depending on the size of the bat and other factors, such as manufacturing tolerances, which may shift the resonances.

In order to obtain a larger damping effect, applicant positioned the electroactive material substantially entirely around the bat at a position near the hand grip. As shown in FIG. 9C, the electroactive material 194 occupies a region extending from the root position of the bat, starting about ten centimeters from the tip, and extending five or ten centimeters along the length of the bat. The material 194 is preferably pre-assembled into a laminated, electroded sheet or package, as described in the aforesaid patent documents, in which the outer layers serve to bind and reinforce the material, while being thin enough to permit effective strain coupling between the bat body and the electroactive material through the intervening layer.

The bat is generally tapered and conical in overall shape, and the laminated package may be pre-formed into a correspondingly fitted curved shell-like shape by a method such as press-lamination as shown in commonly-owned U.S. Pat. No. 5,687,462. The electroactive package is then bonded to the bat body, for example by a thin layer of epoxy or acrylic cement.

In a preferred embodiment however, rather than employing a cylindrical or conical shell package, applicant undertook to build a damping assembly which contained a large area of electroactive material in contact with the bat in the handle region, but achieved the desired area of coverage by including multiple separated panels of electroactive material within the laminated assembly. This allowed the assembly to be bent or wrapped around the handle of the bat, bringing each panel of piezoelectric actuation material into a separate position in alignment against the bat surface so that all are easily attached to the bat in a single operation. By avoiding a large continuous shell structure, the danger of cracking and delamination is avoided. The separate panels were laminated in subregions of a single common sheet assembly, which served as a flexible interconnection of defined size and shape to dependably align and attach the electroactive material to the bat.

In the preferred embodiment, elongated slots were milled through the assembly between the actuator panels, further enhancing the flexibility of the package for fitting to the bat. Eight panels of material were employed in the assembly, and these were arranged in opposed pairs of elements. The pairs were allocated in a first group in which each pair was attached to a separate circuit tuned to cover the lower frequency resonance, and a second group of pairs placed in corresponding circuits tuned to cover the higher frequency resonance. Both groups were formed in a single sheet assembly of the included subregions, and this was configured to wrap around the handle as a continuous unit and to provide a set of leads to the shunt circuitry. The shunt circuitry for this assembly was tuned to provide a separate resonant circuit across each subassembly directed at its targeted mode, i.e., the 165 Hz or the 650 Hz nominal vibrations.

Figure 14:
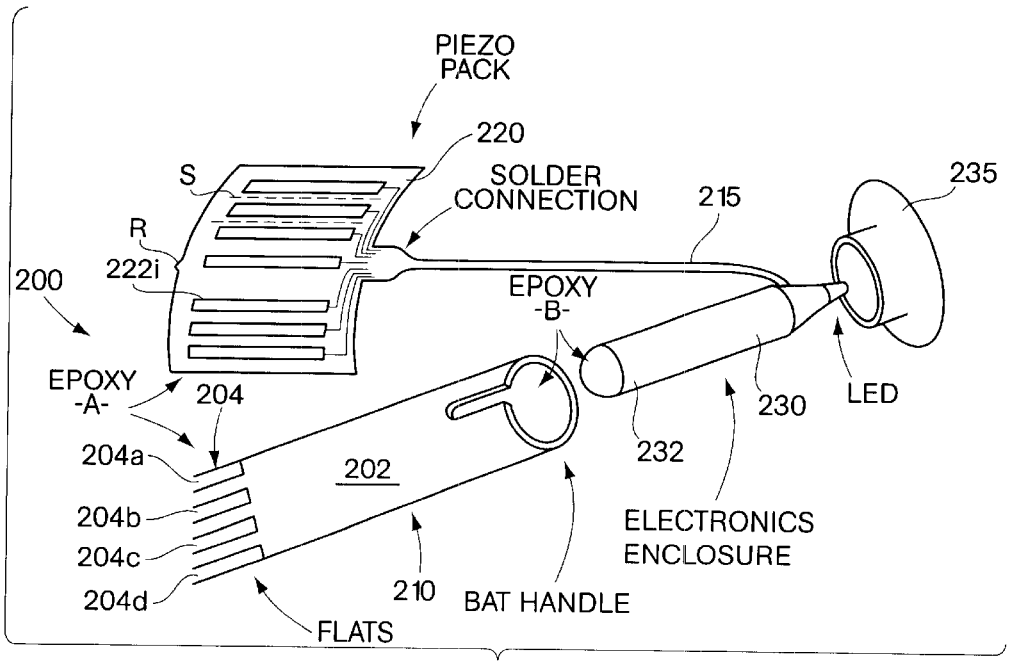
FIG. 14 shows a baseball bat damper construction of the invention.

FIG. 14 illustrates details of such a damped bat assembly 200. As shown, the assembly includes a generally tapered cylindrical bat body 210, an electroactive package 220 containing strain actuation material, and an electronic circuit 230. The illustrated bat is a metal bat formed with a hollow interior, and the electronic circuit 230 is configured to fit within the hollow of the handle through the end of the bat. A cap 235 closes and seals the end of the bat, and the circuit 230 is connected to the package 220 via wire connections 215. As further shown in the Figure, the bat has an extreme end portion 202 generally gripped by the user's hands and constituting, mechanically, the root of the implement, as described above in other contexts. The electroactive material is coupled to the bat body in a mounting portion 204 proximate to the root and away from the general ball contact surface or batting impact area, which lies further up the body of the bat. It will be appreciated by reference to FIG. 9C that the region 204 is under the wrapping and may even be partly or largely covered by the batter's hands in use.

Figure 14A:
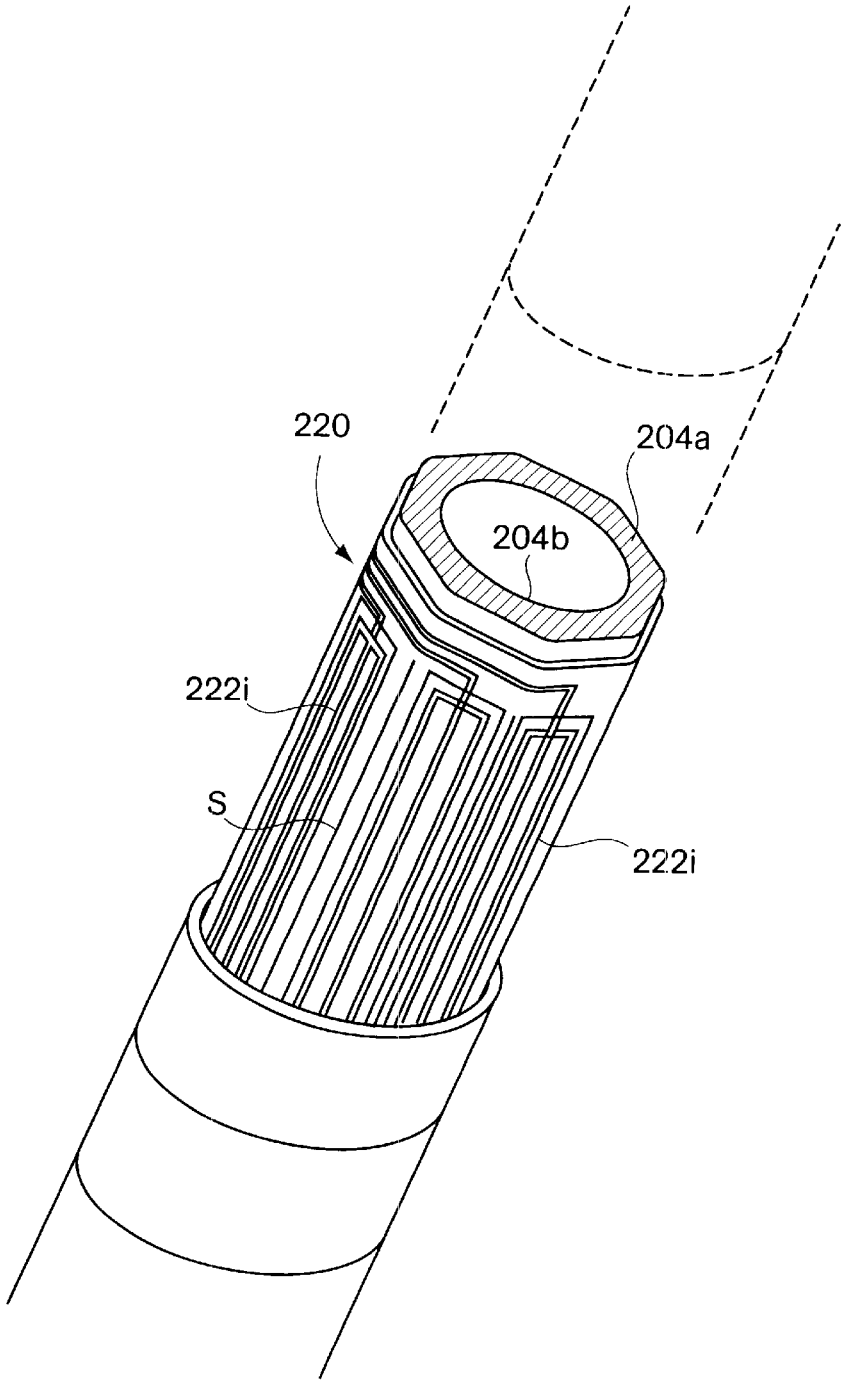
FIG. 14A illustrates details of a preferred embodiment thereof.

As best shown in the view of FIG. 14A, in one embodiment, the mounting portion 204 advantageously has a number of flats 204*a*, 204*b*. . . formed about its circumference, each of which is several inches long and extends over a portion of the circumference so as to provide a flat mounting surface on the generally rounded bat body. Correspondingly, the electroactive pack 220 is illustrated as having eight elongated subregions $\mathbf{222}_i$, each of which contains a thin layer of electroactive material and is electroded by leads which connect opposed sides of the material so as to effectively couple electrical energy across the layer. Score marks S of which one is illustrated may be formed between the adjacent active regions or elements to allow the entire package to flexibly bend or fold and better conform around the bat, and thus also to position each sheet of electroactive material squarely on one of the corresponding mounting faces 204*a*, 204*b*. . . . In addition, registration features R may be provided in the sheet to facilitate alignment and positioning of the assembly when attaching it to the bat surface. The modular electroactive package thus presents a relatively large area of contact, while allowing separate electrodes to reach each sub-element, and providing areas of flexibility to assure that each element may be independently placed and coupled.

The allocation of electroactive elements was further arranged so that each of the groups—the first mode damping pairs and the second mode damping pairs—was positioned so that some elements responded primarily to bending along one direction, and others of the same group responded to bending in a transverse direction. By placing the elements on flats formed on the bat surface, the elements were each coupled to act efficiently on bending of that surface. The provision of a regular eight sided handle area thus allowed placement of a first pair of each group on two opposite faces, and a second pair of the group on two faces oriented perpendicular thereto. The groups targeting the two modes alternated, and were placed at positions shifted by $\pi/4$ around the handle. This arrangement assured that whatever side of the circularly-symmetric bat were to strike the ball, the substantially single-plane bending induced by the ball impact would be effectively captured by one or more pairs of elements in each group.

In accordance with a further and principal aspect of the present invention, the electroactive strips $\mathbf{222}_i$ are arranged in different groupings, and each grouping is connected via leads 215 to separate shunt circuits of the circuit assembly 230, which is housed within an electronics enclosure 232 (FIG. 14). Thus, the electronic circuit 230 is understood to include at least one and preferably several shunts, which as described below, may be and preferably are, of several types or resonance values.

In the preferred embodiment, the shunts are configured so that when placed across a grouping of electroactive sheets $\{\mathbf{222}_i\}$, the intrinsic capacitance, resistance and inductance of the circuit together constitute a resonant circuit at one of the modal frequencies, e.g. the peaks illustrated in FIGS. 13A, 13B, and which operate to enhance and thus more effectively shunt signal energy occurring across the sheets at that frequency. In a preferred embodiment, the circuit elements include a first shunt effective at the lower (165 Hz) resonance and a second shunt effective at the next (650 Hz) resonance, and these shunts are inductive circuits which are detuned, or arranged to resonate over a relatively broad band extending on both sides about the nominal frequency of the respective targeted mode. The design of such broad band inductive shunts is described in further detail in the aforesaid U.S. Patent Application and corresponding International Application.

Figure 15:
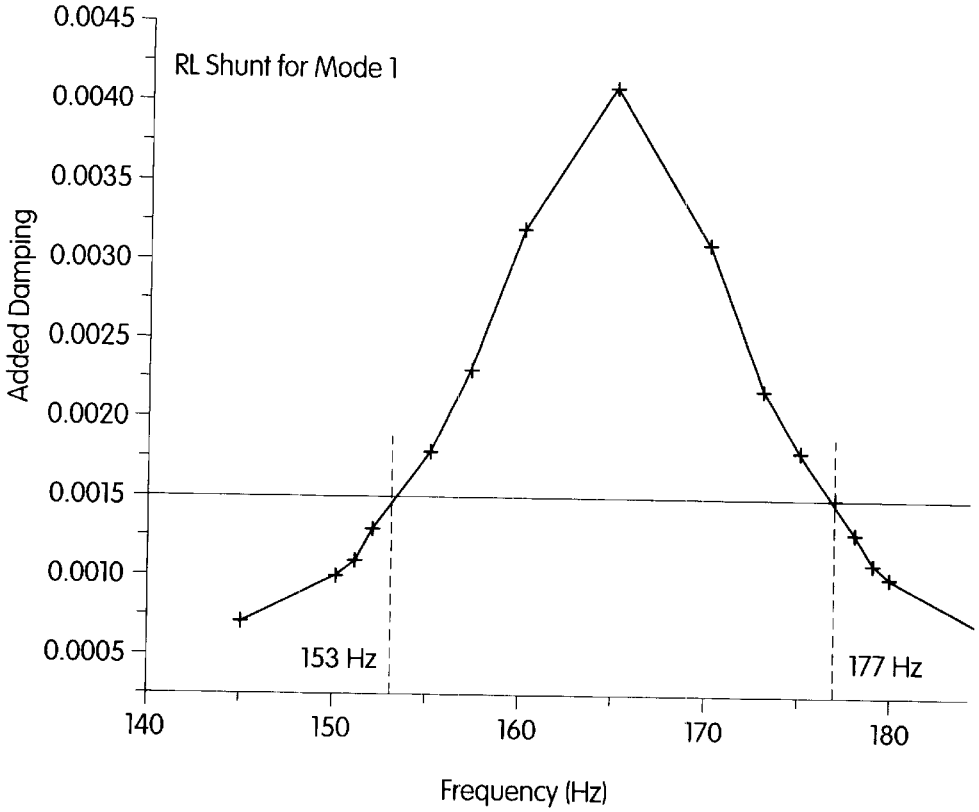
FIG. 15 shows added damping achieved over a modal region of the bat.

FIG. 15 shows the added damping achievable with this construction. As shown, a nodal frequency around 165 Hz was targeted and a level of added damping between about 0.001 and 0.004 was achieved over a band extending approximately 20 Hz on each side of the target frequency. For the higher frequency component, a broader band detuned inductive shunt was employed, and both shunts were placed within the common circuit enclosure 232 and sealed within the bat.

In order to achieve a compact circuit package 232, 230 with relatively little effect on the inertial properties of the bat, the prototype embodiment arranged the eight strips of electroactive material into four subgroups of two strips each. Each opposed pair of strips was connected to a separate inductor wound on a core and all housed within the enclosure 232. This assembly occupied a roughly cylindrical shape approximately 15 millimeters in diameter and eight centimeters long. An LED was placed at the extreme tip and the assembly, after being epoxy bonded within the handle 202 of the bat, was closed with a transparent plastic end cap 253 covering the LED. The LED light source was connected across a voltage conditioning circuit so as to provide a nominal low LED drive voltage and indicate the generation of charge when the bat was subject to vibration. This construction visibly shows the integrity of electrical connections of the assembly, and serves the purpose of reassuring the batter that the damping assembly is operative.

In the bat embodiment, the size of the bat, inertial constraints, and the extreme conditions of use all posed constraints for configuring an effective damping system. Further, the use of inductive shunts with detuned or wide peak resonance to address the expected vibrational spectrum entailed the use of massive electrical coils. By subdividing the electroactive material into patches of small area, applicant was able to cover a sufficient area of the bat to capture several modes effectively using subgroups of separately tuned inductor coils. This circuitry enhanced the strain-generated voltage at the frequencies of interest so that its energy was dissipated by the shunt at an increased rate for those frequencies. Further, by positioning the circuit components centrally within the tip of the handle, the balance, strength, weight and inertial handling of the bat were maintained without compromise.

Many of the foregoing considerations apply to the implementation of damping structures in a golf club, several representative examples of which will now be discussed. Golf clubs vary, having several different possible heads and a range of shaft constructions. One common construction of the shaft is tapered, with a wider handle end tapering down to a narrower distal end at the striking head, which may be a driver, an iron, or other form of head. This taper results in a graded bending stiffness, affecting mode shape. The shaft may also have flared or bulged regions, or may be straight or have other distinctive shape or protruding features. In general, golf clubs have a linear or rod-like structure, with an overall length which may vary from somewhat less than one meter to about 1.3 meters. Because of the generally greater striking force of drivers and irons, these implements may particularly benefit from the electroactive damping or control assemblies of the present invention.

Figure 9D:
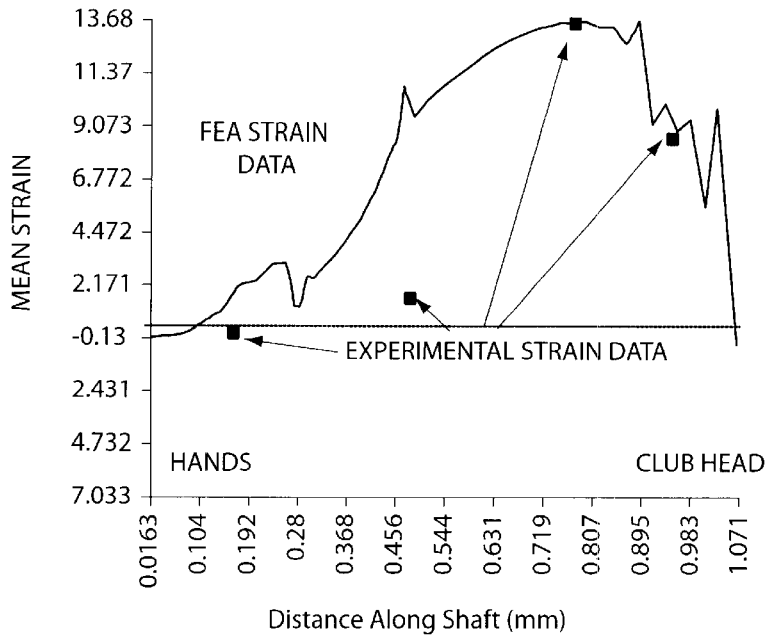
FIGS. 9D–9H illustrate golf club embodiments of the invention.
Figure 9E:
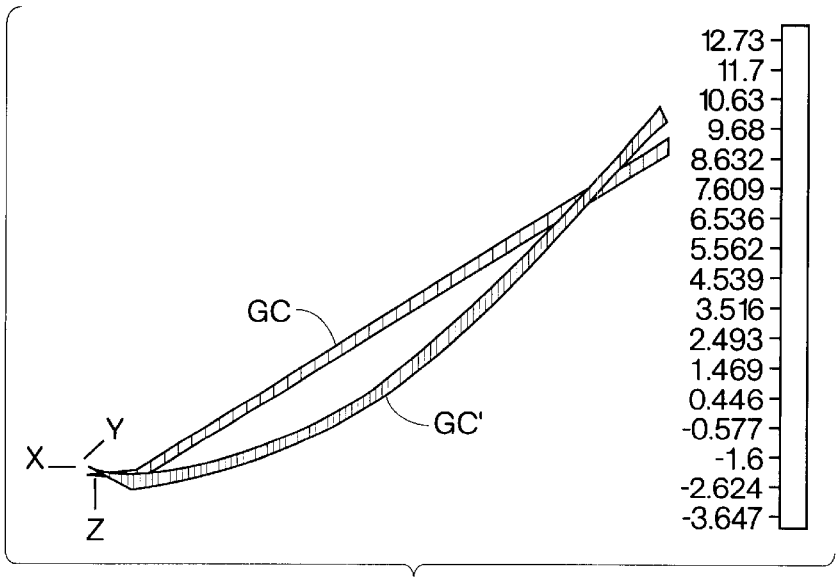

FIG. 9E illustrates the mode shape of a tapered-shaft golf club undergoing a first mode bending displacement. As shown, the undeformed club GC is essentially straight, with the head located at the lower left in the figure, and the hand grip portion at the upper right of the figure. Upon excitation of the first bending mode, the shaft would assume a shape indicated by GC', a slightly asymmetric curve with its apex located closer to the head end than to the handle end. Applicant modeled the resulting distribution of strain energy in the shaft of the club for the first bending mode at 37.5 Hz using a finite element model, the results of which are plotted in FIG. 9D. Four measurement points, indicated by solid squares in FIG. 9D, were also taken. As shown, the level of strain in the shaft has a broad high peak starting near to the club head. The level of strain is generally low at the hand grip region, but rises moderatly steeply descending from the handle.

Figure 9F:
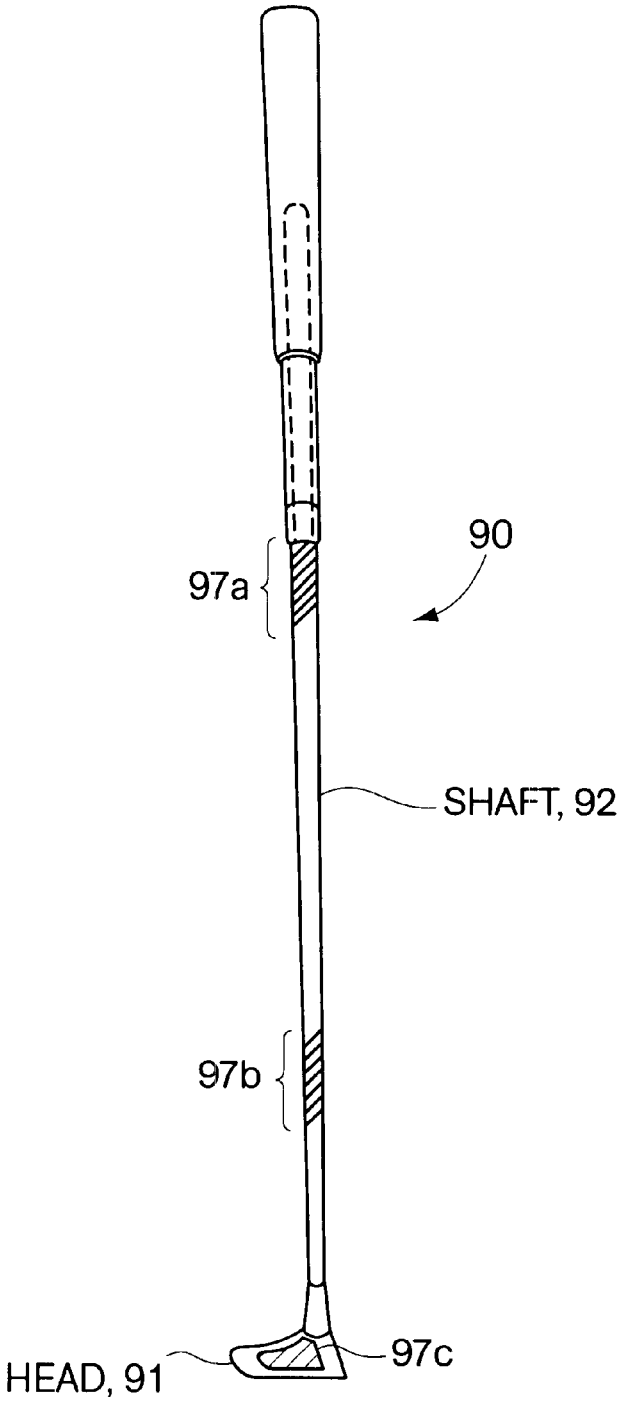
Figure 9G:
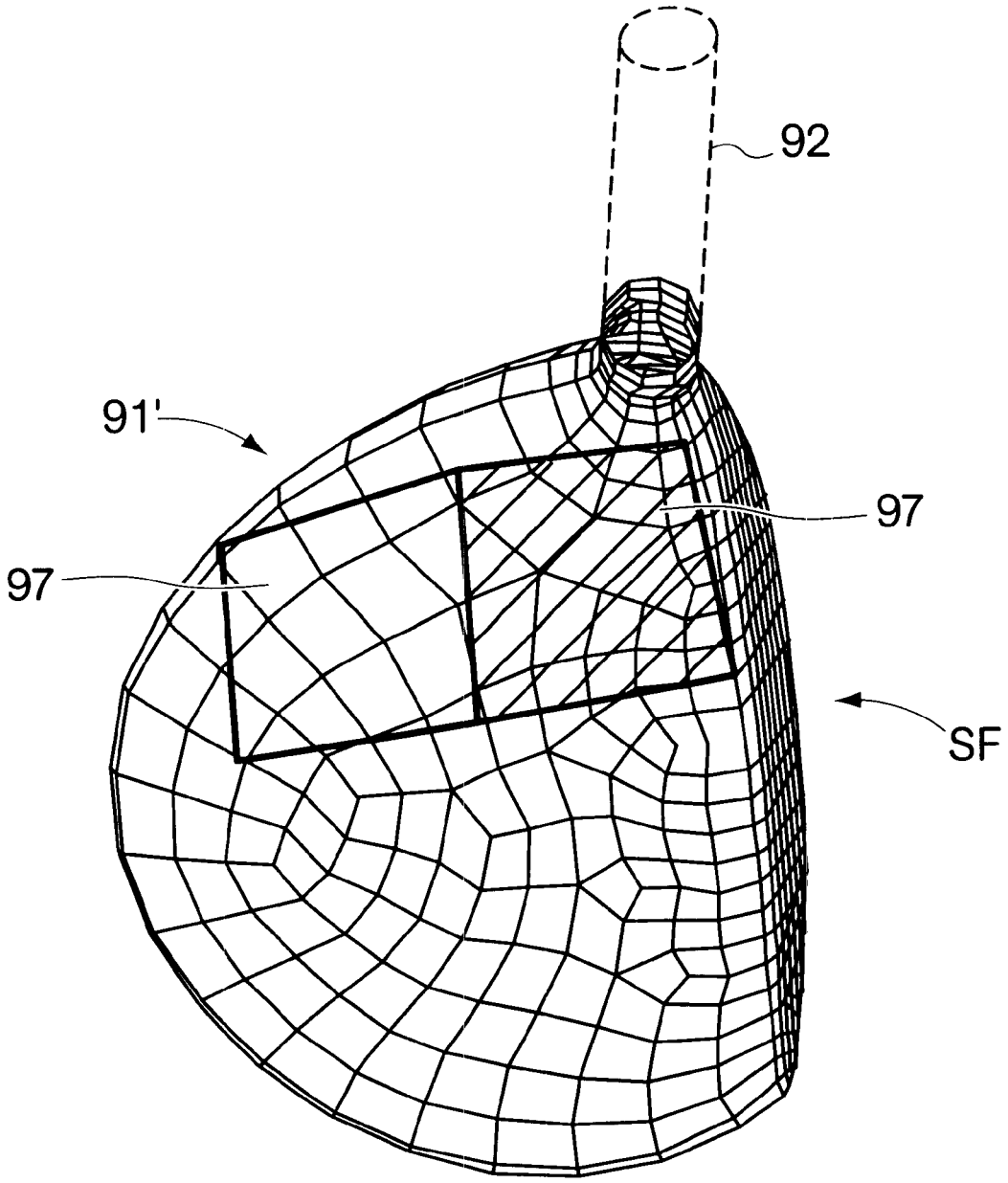
Figure 9H:
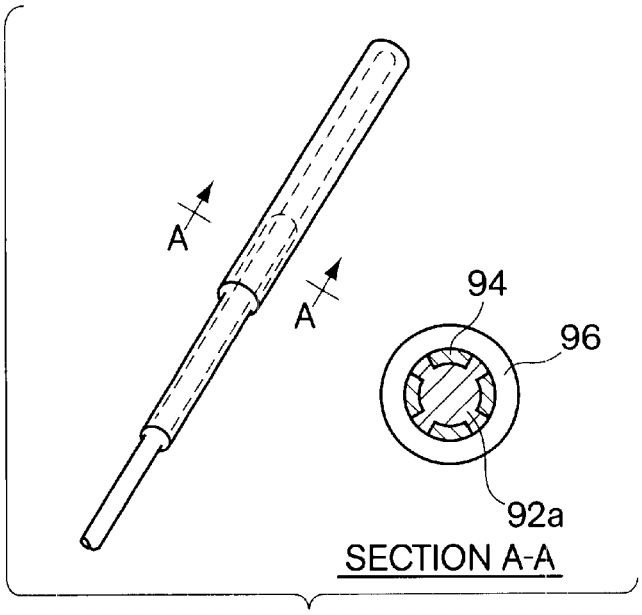

Applicant set about reducing the level of vibration by employing a damping assembly as described above positioned to target a region of high strain and configured to effectively dissipate charge around the frequency of the first mode. FIG. 9F illustrates suitable regions for effective strain coupling of energy out of the club 90. As shown, the handle or grip area of the shaft 92 extends for about 25–35 centimeters from the end, and an first electroactive damping assembly 97*a* may suitably be positioned along an 8–12 centimeter length of the shaft below the handle. Alternatively or in addition, a damping assembly 97*b* may be positioned starting about 5–20 centimeters above the hosel or head, and extending about ten centimeters along the shaft. Finally, for the illustrated iron, a third damping assembly 97*c* is shown mounted on the rear (non-striking) face of the head, on a protected or recessed flat. The dampers 97*a*, 97*b* are positioned to capture strain from the shaft bending modes, while the damper 97*c* affects strain energy in the head caused by impact, before its propagation to the shaft. FIG. 9G is a mechanical rendition of another head, namely a driver 91', of which the striking face SF is shown oriented perpendicular to the plane of the drawing sheet. For this head, a suitable region for locating the strain capture assembly is illustrated by elements 97, attached to the head behind the driving face and near to the shaft. The foregoing positions are representative positions for several existing golf clubs observed by applicant, and other shaft or head regions, features or specially-formed flats or mounting surface regions may be employed as appropriate.

Figure 16A:
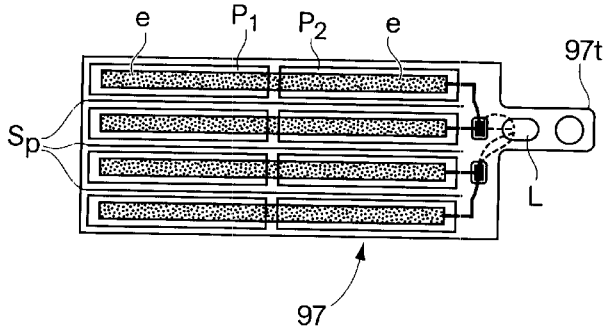
FIGS. 16A–16D illustrate representative electroactive assemblies configured for use on the shaft or head of a golf club embodiment.
Figure 16B:
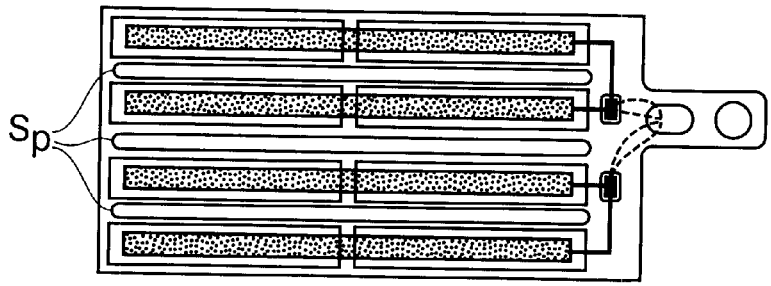

In each illustrated case, the electroactive assemblies are preferably fabricated as sheet assemblies. FIGS. 16A and 16B show suitable assemblies for the shaft-mounted units. As shown in FIG. 16A, eight panels or rectangular regions $P_1, \ldots P_2$ of electroactive material are laid out in a 4×2 array and are electroded by conductors e in a sheet assembly 97. The electrodes e connect to circuit elements which dissipate the transduced strain energy, i.e., the electrical charge generated in the assembly. As noted above for a passive embodiment, these may be resistive, capacitive and/or inductive circuit elements. As illustrated, the assembly has a tab 97*t* in which planar circuit elements to perform this function may advantageously be mounted, preferably together with an LED L or other indicator. Between adjacent rows of strain material, narrow slits or openings sp extend through the sheets to allow the assembly to bend around and conform to the shaft. Similarly to the bat embodiment discussed above, the spacing of adjacent strips of electroactive material is preferably such that a first set of two strips, for example rows one and three, are arranged diametrically opposite each other on the shaft, while a second set of two strips lie in planes orthogonal thereto. In addition, when the assembly is mounted on the shaft of the golf club, these two orthogonally-oriented sets of electroactive elements are preferably each aligned at a $\pi/4$ angle with respect to the front-back bending axis of the shaft, which is fixedly determined by the orientation of the striking face of the head. This assures that each assembly will capture a substantial portion of the strain energy present in the targeted mode, and also that the structural symmetry of the shaft will be maintained.

In one further preferred aspect of such a construction, those electroactive elements placed forwardly of the bending plane or axis are wired together as a group, while those placed rearwardly of the axis are connected as a second group of opposite polarity, and both groups are attached to a common shunt resistor. In a representative implementation of the resistively shunted damper, a shunt resistor of 55 Ω, corresponding to a capacitance of 67 nanoFarads, was used.

Figure 16C:
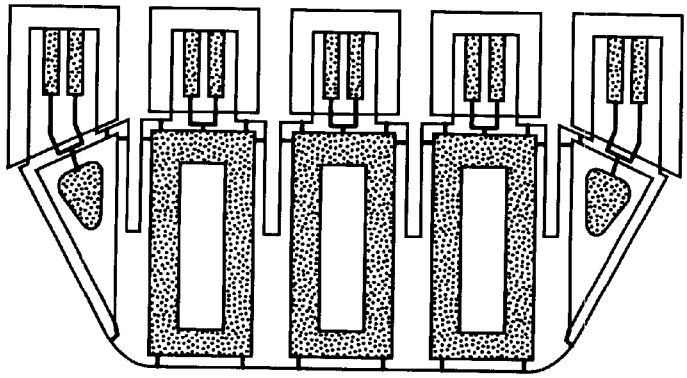
Figure 16D:
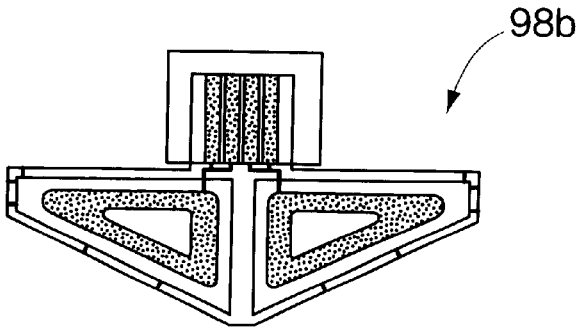

FIG. 16B shows another assembly, similar to the assembly of FIG. 16A. In this assembly, somewhat larger electroactive elements are used, and wider openings are routed through the sheet assembly between the electroactive panels. The shaft may in some embodiments have flats or other features formed on the shaft to adapt it to more effectively receive the strain assembly and couple vibrational energy out of the club. FIGS. 16C and 16D show electroactive strain elements assemblies 98*a*, 98*b* for mounting on the club head.

As shown in FIG. 16C, a multi-fold sheet assembly 98*a* having both rectangular and triangular regions of electroactive material is configured to attach to the non-impact rear facing surface of a driver head. FIG. 16D shows a smaller area assembly 98*b* with fewer fold lines configured for mounting on the rear face of an iron head.

Figure 17:
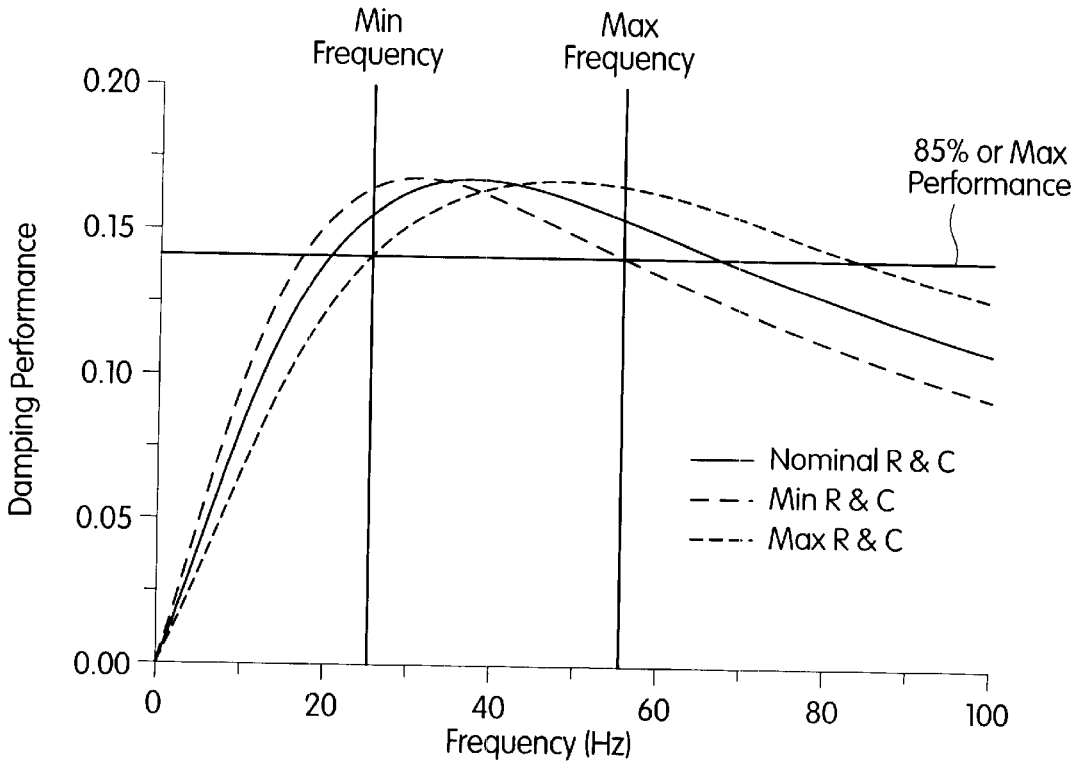
FIG. 17 shows modeled damping performance for an RC shunt assembly.

A basic embodiment of a damped golf club may utilize a simple RC damping circuit, where the resistance R is an external resistor, and the capacitance C is the intrinsic capacitance of the relevant set of electroactive elements, optionally with a supplemental or trimmer capacitor to adjust the total capacitance to resonate at the desired modal resonance. Since the piezo material itself introduces some mass loading and alters structural mechanics of the shaft assembly, one may tune the RC elements to the actual resonance of the completed assembly, which will occur at a lower frequency than the free-shaft resonance. FIG. 17 illustrates the expected damping achieved with such an RC shunt over the relevant range of frequencies. The solid line indicates the calculated damping performance for the nominal values of R and C. Dotted and dashed plots indicate the shift in performance which occurs due to normal variations or tolerance band values of the circuit and electroactive components. As shown, a simple RC circuit arrangement maintains damping efficiency above eighty-five percent of the maximum value over the range 25–70 Hz, amply covering the first mode resonance range of the golf club.

Figure 18A:
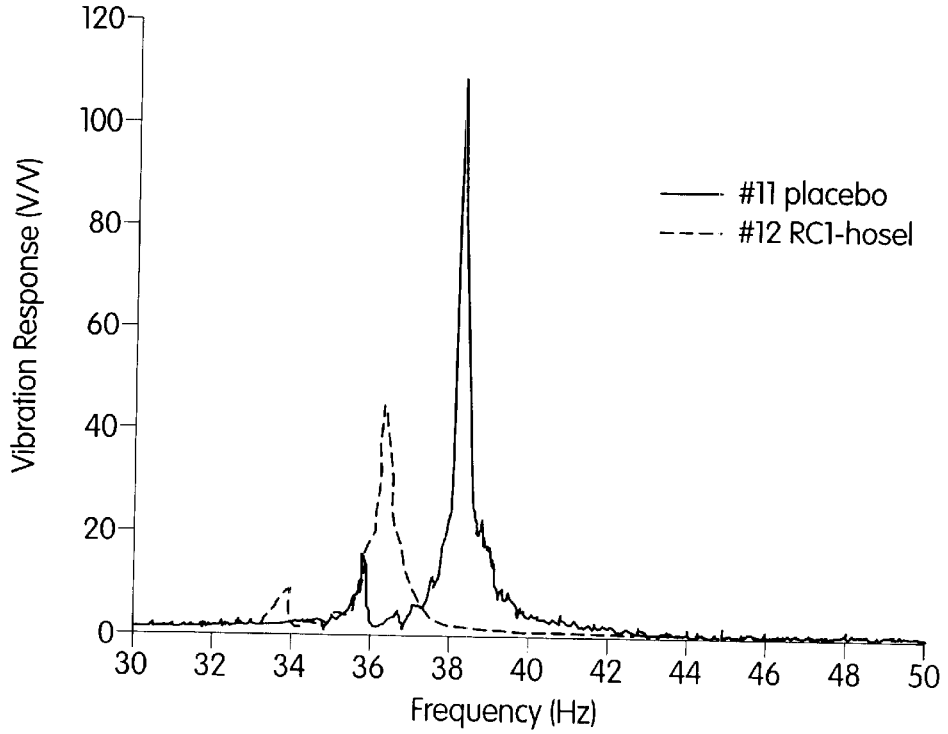
FIGS. 18A and 18B are comparative vibration performance graphs for a driver and for several irons, respectively, employing the damper construction of the present invention.
Figure 18B:
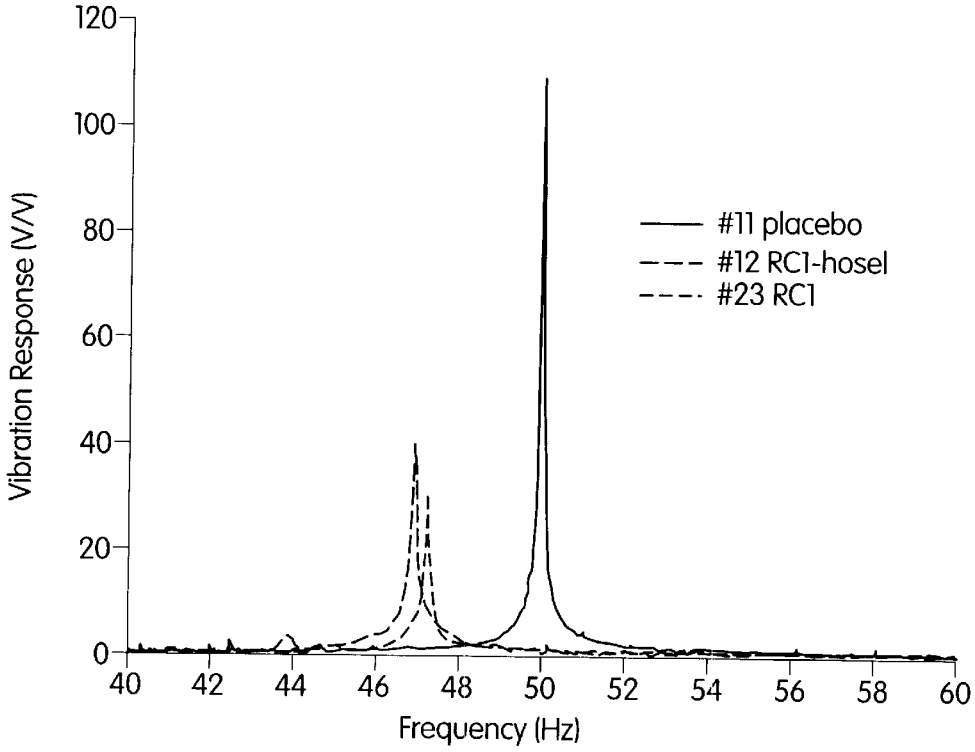

FIG. 18A and FIG. 18B illustrate the measured damping achieved in two different golf clubs using a single electroactive damping assembly 97*b* mounted as illustrated in FIG. 9F. As shown in FIG. 18A, with the damping unit mounted near the hosel, a greatly reduced vibration response having a single peak at about 37 Hz was observed (dashed line plot), as compared to the sharp high amplitude resonance occurring in the same model club without any electroactive damping assembly (solid graph).

FIG. 18B similarly plots the vibrational response of two different damped irons (broken lines), and a corresponding placebo or control iron lacking the electroactive assembly (solid graph). In each case a reduction to well below half of the original amplitude was obtained, and the performance was perceptably enhanced in a manner perceived as desirable.

Figure 10:
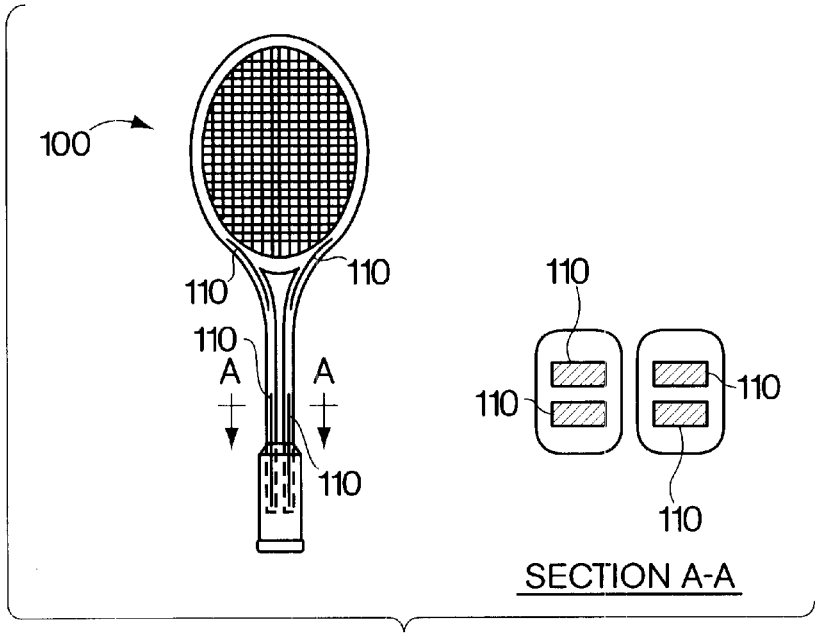
FIG. 10 shows a racquet embodiment of the invention.
Figure 10A:
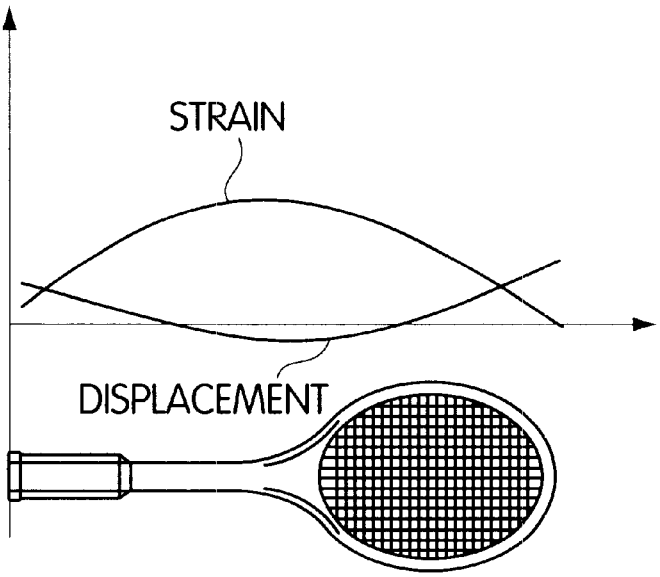
FIG. 10A illustrates strain characteristics thereof.

Returning now to a discussion of other sports implements, FIG. 10 illustrates representative constructions for a racquet embodiment 100 of the present invention. For this implement, actuators 110 may be located proximate to the handle and/or proximate to the neck. In general, it will be desirable to dampen the vibrations transmitted to the root which result form impact. FIG. 10A shows representative strain/displacement magnitudes for a racquet.

Figure 11:
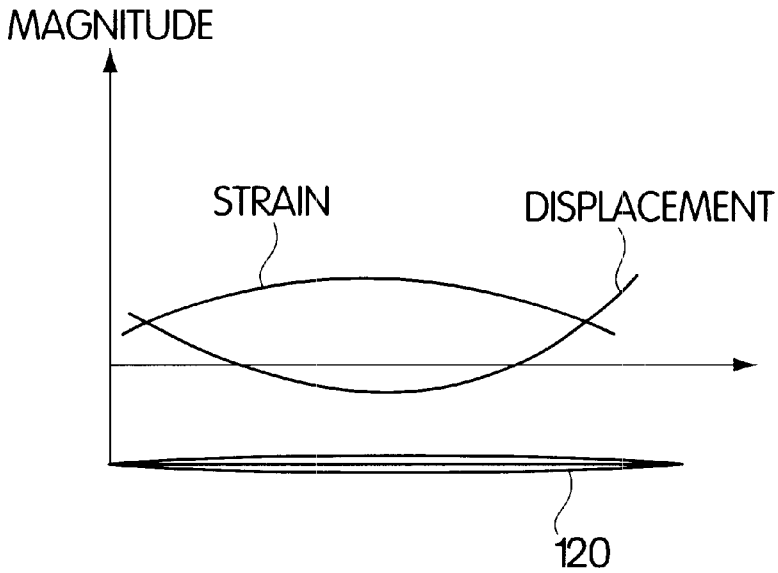
FIG. 11 shows a javelin embodiment of the invention and illustrates strain characteristics thereof.

A javelin embodiment 120 is illustrated in FIG. 11. This implement differs from any of the striking or riding implements in that there is no root position fixed by any external weight or grip. Instead the boundary conditions are free and the entire body is a highly excitable tapered shaft. The strain/displacement chart is representative, although many flexural modes may be excited and the modal energy distribution can be highly dependent on slight aberrations of form at the moment the javelin is thrown. For this implement, however, the modal excitation primarily involves ongoing conversion or evolution of mode shapes during the time the implement is in the air. The actuators are preferably applied to passively damp such dynamics and thus contribute to the overall stability, reducing surface drag.

Figure 12:
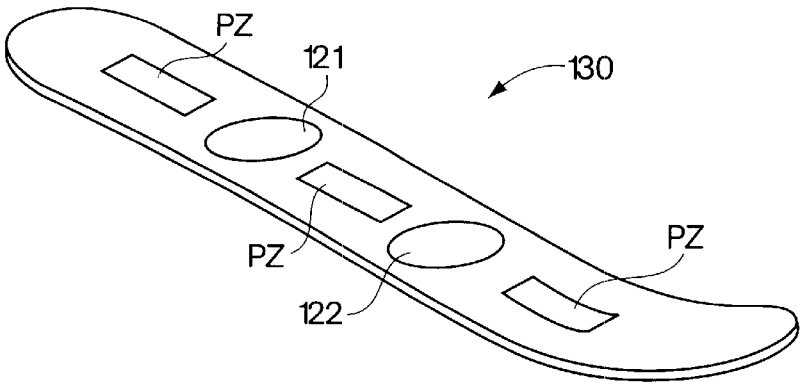
FIG. 12 shows a ski board embodiment of the invention.

FIG. 12 shows a snow board embodiment 130. This sports implement has two roots, given by the left and right boot positions 121, 122, although in use weight may be shifted to only one at some times. Optimal actuator positions cover regions ahead of, between, and behind the boot mountings.

As indicated above for the passive constructions, control is achieved by coupling strain from the sports implement in use, into the electroactive elements and dissipating the strain energy by a passive shunt or energy dissipation element. In an active control regiment, the energy may be either dissipated or may be effectively shifted, from an excited mode, or opposed by actively varying the strain of the region at which the actuator is attached. Thus, in other embodiments they may be actively powered to stiffen or otherwise alter the flexibility of the body.

The invention being thus disclosed and described, further variations will occur to those skilled in the art, and all such variations and modifications are consider to be with the spirit and scope of the invention described herein, as defined in the claims appended hereto.

What is claimed is:

1. A racquet comprising a body having an extent and including a contact surface which is subject in use to stimulation such that the body vibrates with a distribution of strain energy in said body including a region of strain, an electroactive assembly including an electroactive strain element for transducing electrical energy and mechanical strain energy, said electroactive assembly being attached to said body in said region of strain, and a circuit across said assembly configured to dissipate said electrical energy and damp vibration of the body, wherein said circuit is mounted in a sheet assembly.

2. A racquet according to claim 1, wherein said stimulation excites vibrational modes of said body giving rise to said strain distribution, and said assembly and circuit alter the vibrational characteristics to improve handling of the racquet.

3. A racquet according to claim 1, wherein said strain distribution includes an area of high strain and said assembly is attached by a substantially shear free coupling in said area of high strain.

4. A racquet according to claim 1, wherein the electroactive assembly includes plural regions of separately-electroded piezo material.

5. A racquet according to claim 4, wherein the separate regions are configured to damp vibration in different planes.

6. A racquet according to claim 1, wherein the racquet has a grip defining a mechanical root of the racquet and the electroactive material is located down shaft from the grip.

7. A racquet according to claim 1, wherein said assembly includes electroactive material configured to damp vibration occurring along plural different axes.

8. A method of damping a racquet having a shaft, such method comprising strain-coupling an electroactive assembly to a region of the racquet located on the shaft and away from its striking surface to receive strain energy from the racquet and produce electrical charge therefrom, and placing a circuit across the electroactive assembly to shunt the charge and alter strain in said region thereby changing response of the racquet, wherein the step of placing a circuit includes shunting opposed poles of said electroactive assembly to dissipate energy received from said region.

9. The method of claim 8, wherein said electroactive assembly includes separately-electroded electroactive elements and the step of placing a circuit includes placing separate circuits across subsets of said elements to produce damping.

10. The method of claim 9, wherein the step of strain coupling an assembly to receive strain energy includes mounting the assembly near a mechanical root of said racquet over a region effective to receive strain energy from said implement and produce damping of at least (0.15) percent.

11. A racquet comprising a body having an extent and including a contact surface which is subject in use to stimulation such that the body vibrates with a distribution of strain energy in said body including a region of strain, an electroactive assembly including an electroactive strain element for transducing electrical energy and mechanical strain energy, said electroactive assembly being attached to said body in said region of strain, and a circuit across said assembly configured to dissipate said electrical energy and damp vibration of the body, wherein said circuit is an inductive shunt for dissipating charge generated by strain coupled from said region of strain into said element.

12. A racquet according to claim 11, wherein said stimulation excites vibrational modes of said body giving rise to said strain distribution, and said assembly and circuit alter the vibrational characteristics to improve handling of the racquet.

13. A racquet according to claim 12, wherein said strain distribution includes an area of high strain and said assembly is attached by a substantially shear free coupling in said area of high strain.

14. A racquet according to claim 12, wherein the electroactive assembly includes plural regions of separately-electroded piezo material.

15. A racquet according to claim 14, wherein the separate regions are configured to damp vibration in different planes.

16. A racquet according to claim 12, wherein the racquet has a grip defining a mechanical root of the racquet and the electroactive material is located down shaft from the grip.

17. A racquet according to claim 11, wherein said assembly includes electroactive material configured to damp vibration occurring along plural different axes.

18. A racquet comprising a body having an extent and including a contact surface which is subject in use to stimulation such that the body vibrates with a distribution of strain energy in said body including a region of strain, an electroactive assembly including an electroactive strain element for transducing electrical energy and mechanical strain energy, said electroactive assembly being attached to said body in said region of strain, and a circuit across said assembly configured to dissipate said electrical energy and damp vibration of the body, wherein said strain element is embedded in a shaft formed of composite material.

19. A racquet according to claim 18, wherein said stimulation excites vibrational modes of said body giving rise to said strain distribution, and said assembly and circuit alter the vibrational characteristics to improve handling of the racquet.

20. A racquet according to claim 18, wherein said strain distribution includes an area of high strain and said assembly is attached by a substantially shear free coupling in said area of high strain.

21. A racquet according to claim 18, wherein the electroactive assembly includes plural regions of separately-electroded piezo material.

22. A racquet according to claim 21, wherein the separate regions are configured to damp vibration in different planes.

23. A racquet according to claim 18, wherein the racquet has a grip defining a mechanical root of the racquet and the electroactive material is located down shaft from the grip.

24. A racquet according to claim 18, wherein said assembly includes electroactive material configured to damp vibration occurring along plural different axes.

* * * * *